US010455323B2

(12) United States Patent
Zernicki et al.

(10) Patent No.: US 10,455,323 B2
(45) Date of Patent: Oct. 22, 2019

(54) MICROPHONE PROBE, METHOD, SYSTEM AND COMPUTER PROGRAM PRODUCT FOR AUDIO SIGNALS PROCESSING

(71) Applicant: ZYLIA SPOLKA Z OGRANICZONA ODPOWIEDZIALNOSCIA, Poznan (PL)

(72) Inventors: Tomasz Zernicki, Poznan (PL); Maciej Kurc, Poznan (PL); Marcin Chryszczanowicz, Poznan (PL); Jakub Zamojski, Lublin (PL); Piotr Makaruk, Warsaw (PL); Piotr Szczechowiak, Poznan (PL); Lukasz Januszkiewicz, Jastrowie (PL)

(73) Assignee: ZYLIA SPOLKA Z OGRANICZONA ODPOWIEDZIALNOSCIA, Poznan (PL)

( * ) Notice: Subject to any disclaimer, the term of this patent is extended or adjusted under 35 U.S.C. 154(b) by 0 days.

(21) Appl. No.: 16/076,951

(22) PCT Filed: Feb. 9, 2017

(86) PCT No.: PCT/IB2017/050714

§ 371 (c)(1),
(2) Date: Aug. 9, 2018

(87) PCT Pub. No.: WO2017/137921

PCT Pub. Date: Aug. 17, 2017

(65) Prior Publication Data

US 2019/0052957 A1 Feb. 14, 2019

(30) Foreign Application Priority Data

Feb. 9, 2016 (PL) ..... PL416068
Jul. 11, 2016 (PL) ..... PL417913

(51) Int. Cl.
*H04R 1/40* (2006.01)
*H04R 3/00* (2006.01)
*H04R 19/04* (2006.01)

(52) U.S. Cl.
CPC ..... *H04R 1/406* (2013.01); *H04R 3/005* (2013.01); *H04R 19/04* (2013.01); *H04R 2201/003* (2013.01); *H04R 2201/401* (2013.01)

(58) Field of Classification Search
CPC ..... H04R 1/406; H04R 3/005; H04R 19/04; H04R 2201/003; H04R 2201/401
See application file for complete search history.

(56) References Cited

U.S. PATENT DOCUMENTS 9,521,486 B1 * 12/2016 Barton ..... H04R 3/005
2010/0315231 A1 12/2010 Williams
(Continued)

FOREIGN PATENT DOCUMENTS

EP 2 773 131 A1 9/2014
WO 2011101045 A1 8/2011
WO 2017/137921 A1 8/2017

OTHER PUBLICATIONS

European Patent Office, International Searching Authority, International Search Report for Application No. PCT/IB2017/050714, dated Jun. 30, 2017.

(Continued)

*Primary Examiner* — Andrew L Sniezek
(74) *Attorney, Agent, or Firm* — Social IP Law Group LLP; Nikki M. Dossman

(57) ABSTRACT

The invention concerns a microphone probe having a body being substantially a first solid of revolution with a number of audio sensors distributed thereon and located in the recesses. The recesses have substantially a shape of a second body of revolution with an axis of symmetry perpendicular to the surface of the body. The sensors are connected to an (Continued)

acquisition unit, that delivers audio signals to the output. The audio sensors are digital audio sensors comprising printed circuit board with MEMS microphone element mounted thereon, wherein MEMS microphone element is mounted on the side of the printed circuit board facing the inner side of the body, so that the sound reaches MEMS microphone element via recess and opening. The depth of recesses is in a range between 3 and 20 mm. The acquisition unit has a clocking device determining common time base for audio sensors.

18 Claims, 13 Drawing Sheets

(56) References Cited

U.S. PATENT DOCUMENTS

2011/0026730 A1* 2/2011 Li ..... H04R 3/005 381/92
2012/0275621 A1* 11/2012 Elko ..... H04R 19/016 381/92
2014/0023199 A1* 1/2014 Giesbrecht ..... G10L 21/0216 381/71.1
2014/0153740 A1* 6/2014 Wolff ..... H04R 3/005 381/92
2018/0213326 A1* 7/2018 Huttunen ..... H04R 5/027

OTHER PUBLICATIONS

European Patent Office, International Searching Authority, Written Opinion for Application No. PCT/IB2017/050714, dated Jun. 30, 2017.

* cited by examiner

| Frequency Band [Hz] | Wavelenghts λ [m] | Dist. max limit λ/2 [cm] | Dist. minimum limit (λ/2)/10 [cm] |
|---|---|---|---|
| 10-100 | 34-3.4 | 170 | 17 |
| 100-200 | 3.4-1.7 | 85 | 8.5 |
| 200-400 | 1.7-.85 | 42.5 | 4.25 |
| 400-800 | .85-.425 | 21.25 | 2.125 |
| 800-1600 | .425-.2125 | 10.625 | 1.0625 |
| 1600-3200 | .2125-.10625 | 5.3125 | .53125 |
| 3200-6400 | .10625-.053125 | 2.6562 | .26562 |
| 6400-12800 | .053125-.026562 | 1.3281 | .13281 |
| 12800-25600 | .026562-.013281 | .66405 | .066405 |

MICROPHONE PROBE, METHOD, SYSTEM AND COMPUTER PROGRAM PRODUCT FOR AUDIO SIGNALS PROCESSING

The invention concerns Microphone probe, method for processing of audio signals from microphone probe, audio acquisition software and computer program product for audio acquisition. More particularly the invention concerns microphone probe, method for audio acquisition and audio acquisition system dedicated for recording multisource audio data into the channels corresponding to the particular sources.

Recording and distribution of the music is known to be difficult, time-consuming and expensive. A musical band wishing to publish its music needs to hire professional studio to record the music, then process the music and finally embed the music in a carrier. The last step has nearly been eliminated by replacing distribution of music carriers, i.e. tapes, compact discs etc. with network transmission.

If professional studio could be eliminated from the process, the recording of music would become definitely simpler. However, that would require possibility of extraction from the sound generated by playing musical band tracks corresponding to particular sources with relatively simple device and with elimination of echo and interferences.

US patent application no. US 20030147539 A1 discloses a microphone array-based audio system that is designed to support representation of auditory scenes using second-order harmonic expansions based on the audio signals recorded with the microphone array. For example, in one embodiment, the quoted invention comprises a plurality of microphones i.e., audio sensors mounted on the surface of an acoustically rigid sphere.

US patent document no. US 2008247565 A discloses an audio system that generates position-independent auditory scenes using harmonic expansions based on audio signals recorded with a microphone array. In one embodiment, a plurality of audio sensors are mounted on the surface of a sphere. The number and location of the audio sensors on the sphere are designed so as to enable the audio signals generated by those sensors to be decomposed into a set of eigenbeam outputs. Compensation data corresponding to at least one of the estimated distance and the estimated orientation of the sound source relative to the array are generated from eigenbeam outputs and used to generate an auditory scene. Compensation based on estimated orientation involves steering a beam formed from the eigenbeam outputs in the estimated direction of the sound source to increase direction independence, while compensation based on estimated distance involves frequency compensation of the steered beam to increase distance independence.

Audio systems disclosed in US applications nos. US 2000147539 A1 and US 2008247565 A have a disadvantage related to the need of performing analog to digital conversion of the signal from every audio sensor in the matrix. They are also susceptible to external interferences. Manufacturing process of spherical arrays of analogue audio sensors proved to be quite time-consuming and complicated.

International patent application no. PCT/US2010/061445 and US patent applications no. US 20140270245 A1 disclose that using PCB technology and surface-mounted MEMS microphones and associated electronics can greatly simplify the construction of a 3D array and thereby can result in a design that is less expensive to manufacture. The physical microphone design results in some physical limitations that are made to optimize the acoustic performance of the microphone. However MEMS as digital audio sensors proved to have low signal-to-noise ratio, which makes them unsuitable for applications in recording music. Solution to this problem suggested in US 20140270245 A1 was to use multiple MEMS elements serving as a single audio sensor.

Generally, state of the art methods, devices and systems seem to be susceptible to noise and interferences, which is tolerable in numerous applications, but not in recording music.

It is an object of the present invention to provide Microphone probe, method for processing of audio signals from microphone probe, audio acquisition software and audio acquisition software that would allow recording high quality multichannel sound generated by playing instruments in quite random environment.

A microphone probe according to the invention has a body being substantially a first solid of revolution with a number of audio sensors distributed thereon. The audio sensors are located in recesses having substantially a shape of a second body of revolution having an axis of symmetry perpendicular to the surface of the body. The audio sensors are connected to an acquisition unit that delivers audio signals received by the audio sensors to an output. The audio sensors are digital audio sensors, each comprising a printed circuit board with a MEMS microphone element mounted thereon. The MEMS microphone element is mounted on the side of the printed circuit board facing the interior of the body so that the sound reaches the MEMS microphone element via the recess and an opening in the printed circuit board. This method of mounting results in the microphone being mounted in a spatial filtering element formed by a recess and an additional conduit formed by the opening in the PCB. Such configuration proved to be efficient in preventing spatial aliasing. The depth of the recesses is within a range between 3 and 20 mm. The acquisition unit has a clocking device determining common time base for the audio sensors. The acquisition unit is adapted to feed the signals from particular audio sensors to a processing unit. Such configuration results in a synchronization between the audio sensors good enough to provide data for further beamforming and processing.

Preferably processing unit is integrated with microphone probe.

Preferably acquisition unit is implemented as FPGA unit with $B_F$ bit logic while digital audio sensors provide $B_S$ bit samples, wherein $B_F$ is lower or equal $B_S$, and wherein a conversion is done with module having $(2B_S-B_F)$ bit buffer. Preferably $B_F$ is equal to 16 and $B_S$ is equal to 24. The module is adapted to:

- write sample into the buffer setting bits from 0 to $(B_S-1)$th with the bits of the sample and setting bits from $B_S$ to $(2B_S-B_F-1)$th to value of $(B_S-1)$th bit of the sample,
- apply the value of gain by shifting the bits of buffer to the left by a given number of positions
- detect saturation when either
  - bit $(2B_S-B_F-1)$ is "0" and bits $(2B_S-B_S-2)$ to $(B_S-1)$ are filed with "1"
- or
  - bit $(2B_S-B_F-1)$ is "1" and bits $(2B_S-B_F-2)$ to $(B_S-1)$ are filed with "0"
- return either saturation information or the value of the bits $B_S-1$ to $B_S-B_F$ of the buffer as return value.

Preferably the body of the microphone probe is substantially spherical and preferably has at least 20, advantageously 32 digital audio sensors or even more preferably 62 digital audio sensors. The term substantially spherical refers to any sphere-like shape in particular dodecahedron or other spherical polyhedron. If probe is supposed to be located on the table it is possible to eliminate bottom (south pole) sensor and reduce the number of sensors to 19 still keeping the functionality of the brobe.

Digital audio sensors are preferably distributed in evenly spaced layers or parallel layers corresponding to evenly distributed angles of latitude.

Also preferably the body of the microphone probe is substantially cylindrical and digital audio sensors are uniformly distributed on its lateral surface.

A method according to the invention refers to processing audio signals method comprising the steps of:

acquisition of first number of signals from digital audio sensors, determing direction of arrival of the sound from a second number of sources, applying beamforming to obtain a number of channels corresponding to this sources from acquired signals using a filter table.

In the method according to the invention the frequency band of the acquired signals is divided at least into first frequency band and second frequency band while a first beamforming method is applied in the first frequency band and a second beamforming method is applied in the second frequency band. The method according to the invention further comprises a step of:

applying postprocessing including filtration of at least one of the channels with the source specific filtration.

Consequently the method according to the invention can be used in broader frequency band than the method known in the state of the art and provide processing required in processing sound originating from musical instruments.

Preferably the determining direction of arrival of the sound from the number of sources includes receiving at least partial indication of the location of at least one source with user interface prior during or after the acquisition.

The reception of at least partial indication of the location of at least one source with user interfaces preferably precedes the acquisition of signals from the audio signals. Additionally the method preferably includes additional step of determining the impulse response or transmittance of a link between at least one source and the digital audio sensors of the probe. This step is executed before acquisition. The measured impulse response or the spatial channel transfer function is used to compensate the effect of environment on the sound from at least one source.

Preferably number of digital audio sensors used in beamforming depend on the frequency band and is selected so that the spacing between sensors is greater than 0.05 of the wavelength and lower than 0.5 of the wavelength in each of the frequency bands.

The upper limit of 0.5 wavelength corresponds to possibility of implementing a beamforming without spatial aliasing. The lower limit is dictated by the increase of the noise of the related to beamforming. Keeping that limits is difficult when processing the music because of the large bandwidth resulting in a wide range of wavelengths for which the condition has to be met. Having a greater number of audio sensors and using only part of them in frequency bands for which lower condition is not met solves the problem.

Preferably the method includes adaptive Wiener filtration of at least first channel, preferably involving adaptive filtering and subtraction of signals from at least two other channels. That kind of filtration increases signal to interference ration in the first channel taking benefit of the signals collected in the other channels.

Preferably, the beamforming is based on a correlation matrix Sxx between the signals from the audio sensors of the microphone probe or alternatively on the frequency response matrix of the microphone probe, preferably frequency response matrix measured earlier in an anechoic chamber.

An audio acquisition system according to the invention comprises a microphone probe according to the invention, a processing unit capable of carrying on a method according to the invention, and external interface to output the channels containing sound originating from particular sources.

A computer program product according to the invention is adapted to be executed on a computer connected via USB interface with a probe according to the invention and is adapted to carry on a method according to the invention. Preferably, this product contains measurement results of frequency response matrix of at least one particular microphone probe.

The invention has been described in detail below with reference to the attached drawings, wherein:

FIG. 1 shows an embodiment of the microphone probe in a perspective view.

FIG. 2*a* shows an enlarged view of a single digital audio sensor as mounted in the embodiment of the microphone probe, with hemispherical recesses.

FIG. 2*b* shows an enlarged view of a single digital audio sensor as mounted in the another embodiment of the microphone probe, with exponential recesses.

FIG. 2*c* shows an enlarged view of a single digital audio sensor as mounted in the another embodiment of the microphone probe, with elliptical recesses.

FIG. 2*d* shows an enlarged view of a single digital audio sensor as mounted in the another embodiment of the microphone probe, with conical recesses.

FIG. 3*a* shows a block diagram of the microphone probe according to the invention.

FIG. 3*b* shows a schematic of the acquisition unit of an embodiment of the invention.

FIG. 3*c* shows a schematic of the connection board of the embodiment of the invention.

FIG. 3*d* shows a schematic of the audio sensor with the MEMS microphone element in an embodiment of the invention.

FIG. 4*a-e* present various examples of the distribution of the audio sensors on the probe according to the invention.

Figures 7A, 7B:
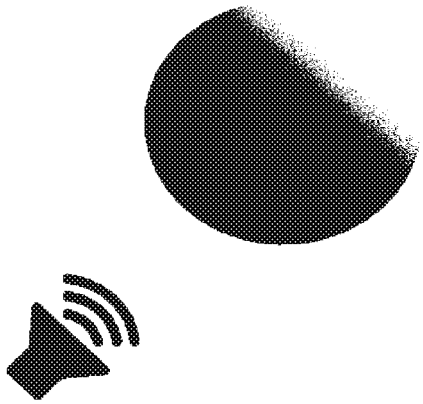

FIG. 7*a* illustrates the shadowed microphone weighting technique.

FIG. 7*b* illustrates boundary conditions for selecting microphones.

Figure 7C:
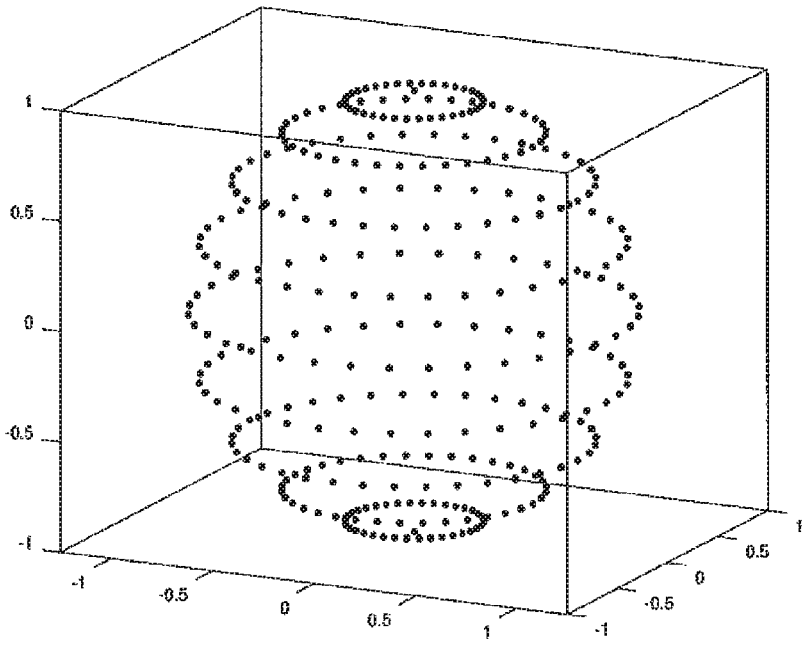
Figure 7D:
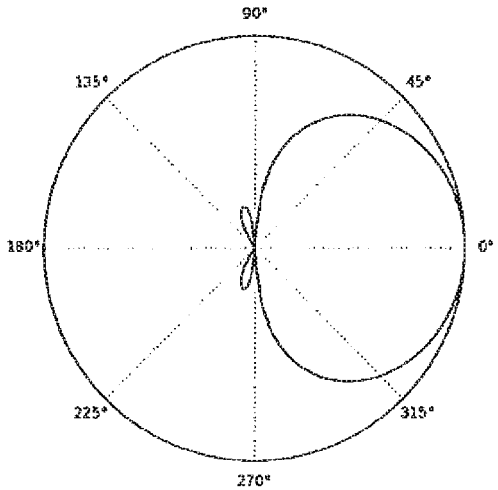
Figure 7E:
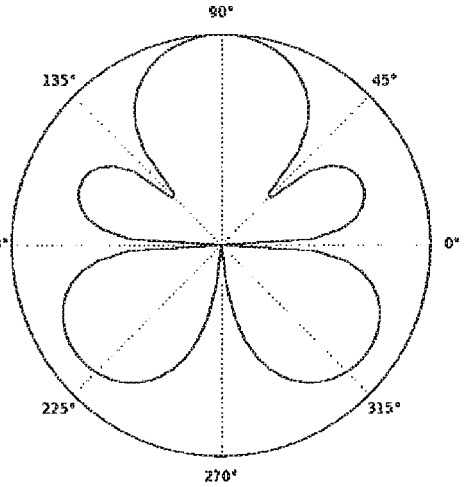
Figure 7F:
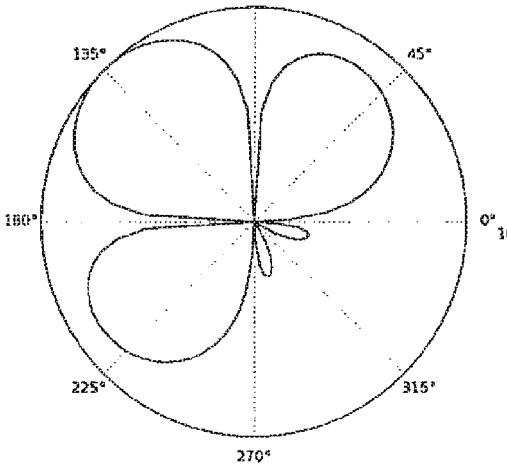
Figure 7G:
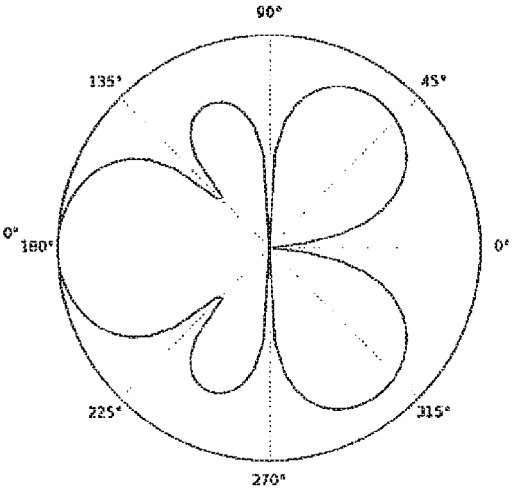

FIG. 7*c* illustrates a relative distribution of 3D sound sources during probe characterization.

FIGS. 7*d-g* present exemplary directivity patterns corresponding to four channel example of operation of the system according to the invention executing a method according to the invention.

Figure 8:
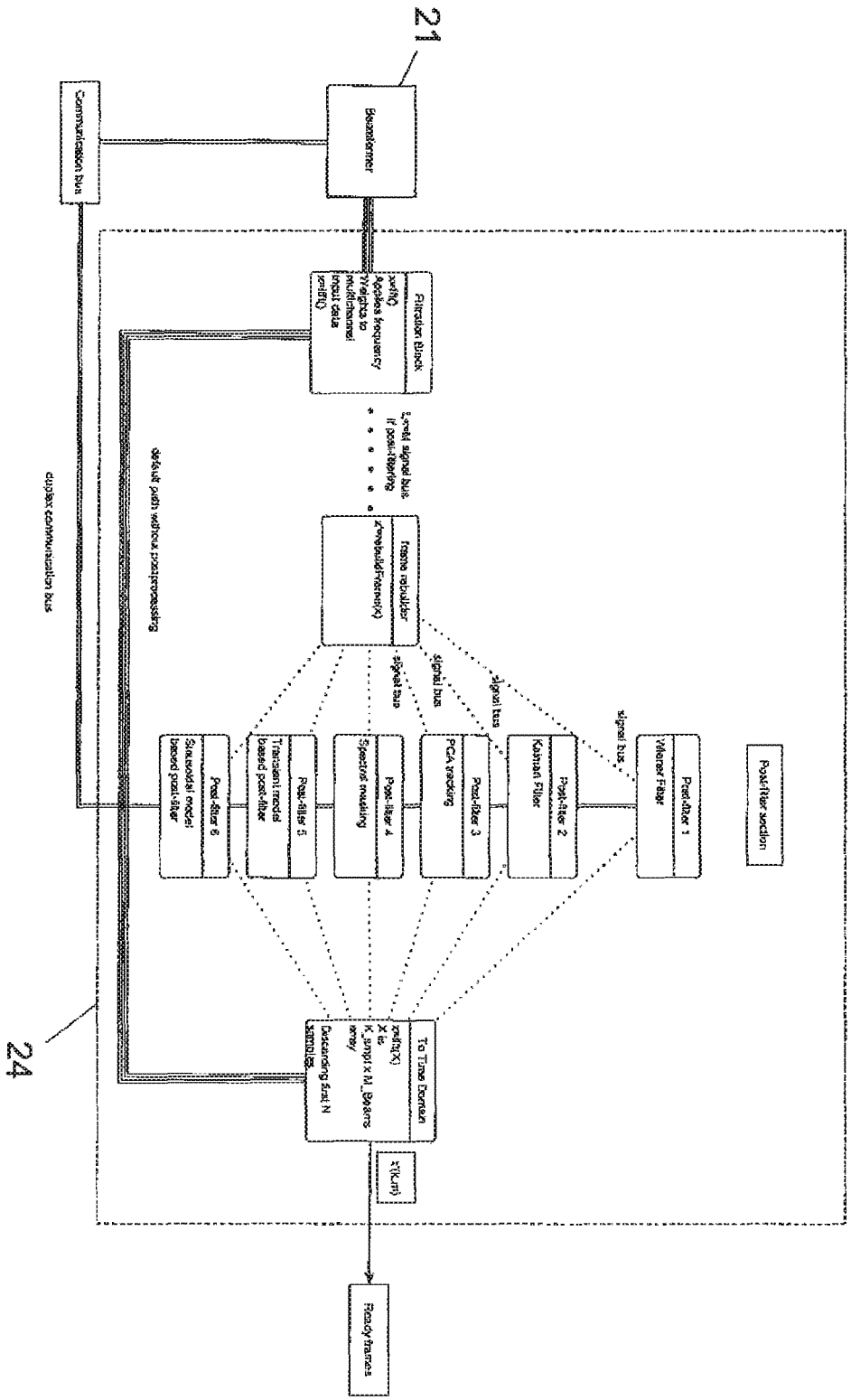

FIG. 8 shows functional block diagram of a filtering block.

Figure 1:
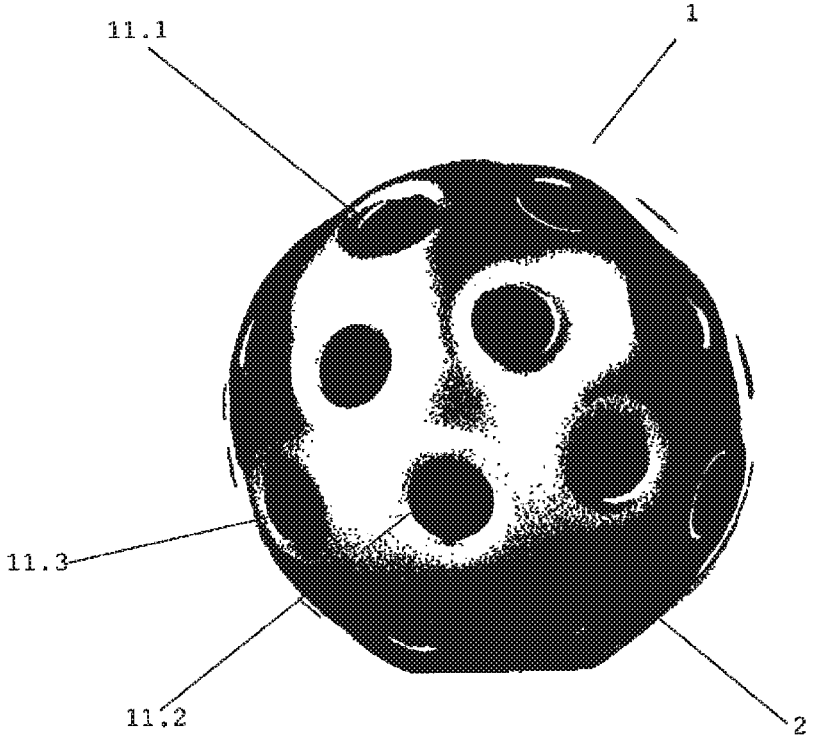
Figure 2A:
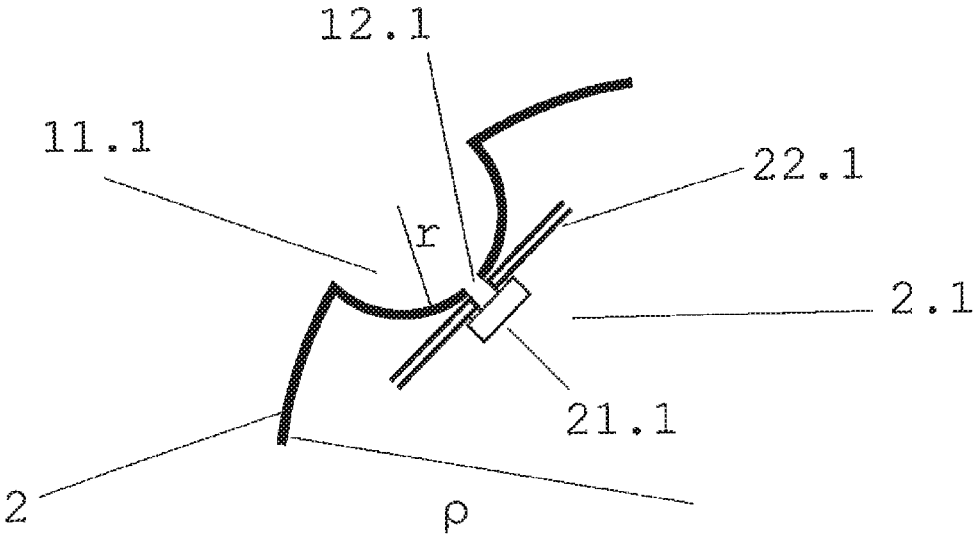

In its first embodiment shown in FIG. 1, a microphone probe 1 according to the invention has a hollow body 2 that has substantially spherical shape having radius ρ equal to 52.5 mm. On the surface of this hollow body there are provided recesses 11.1, 11.2, 11.3 of substantially hemispherical shape as illustrated in FIG. 2*a*. The radius r of these recesses in the present example is 15 mm. As presented in FIG. 2*a*, below the recess 11.1 a first printed circuit board—PCB 22.1 is located. It is a board dedicated solely to the single digital audio sensor. A MEMS microphone element 21.1 is surface-mounted on the inner side of PCB 22.1—that is on the surface closer to the center of the hollow body 2. The MEMS microphone element footprint on the PCB 22.1 is provided with an opening 12.1. The PCB 22.1 is located below the hemispherical recess 11.1, inside the hollow body 2, so that the opening 12.1 corresponds to an opening in the bottom point of the recess, as presented in FIG. 2*a*. The sound coming from the outside reaches the MEMS microphone element 21.1 through the opening in the bottom point of the recess and through the opening 12.1 in the PCB 22.1. The PCB 22.1 with the MEMS microphone element 21.1 mounted thereon form a digital audio sensor 2.1 capable of communicating with an acquisition unit 3 (not shown in FIGS. 2*a-d*).

Figure 2B:
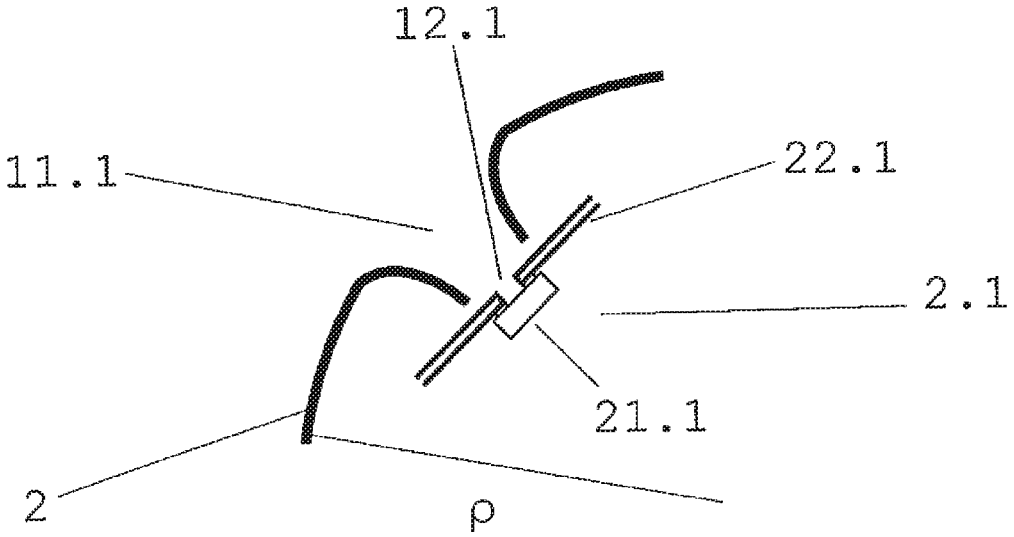

In an another embodiment shown in FIG. 2*b*, the recess 11.1 has a shape of a body of revolution obtained with a rotation of a segment of $2e^{x/15mm}$ function around the axis X. The segment corresponds to the range x ∈(0.20 mm). The exponential shape of the recess 11.1 has an advantage of better directivity, but is more difficult to manufacture.

Figure 2C:
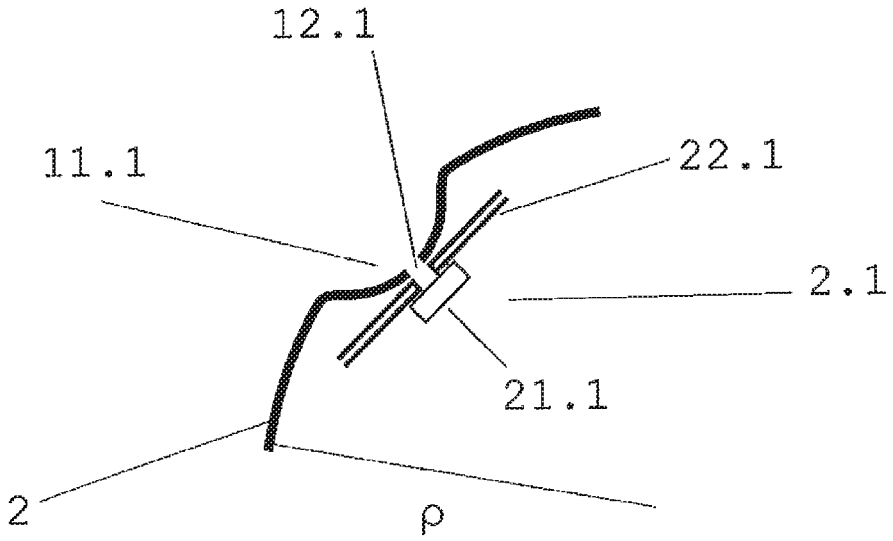

In yet another embodiment shown in FIG. 2*c* the recess 11.1 has elliptical shape.

Figure 2D:
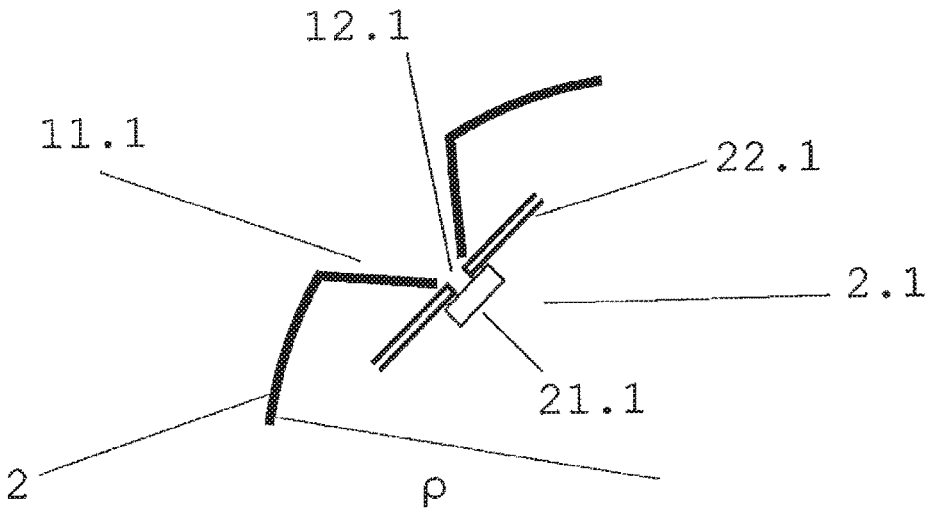

Further alternative is a conical shape illustrated in FIG. 2*d*. The recess 11.1 in this embodiment has a shape of a tapered cone.

Figure 3A:
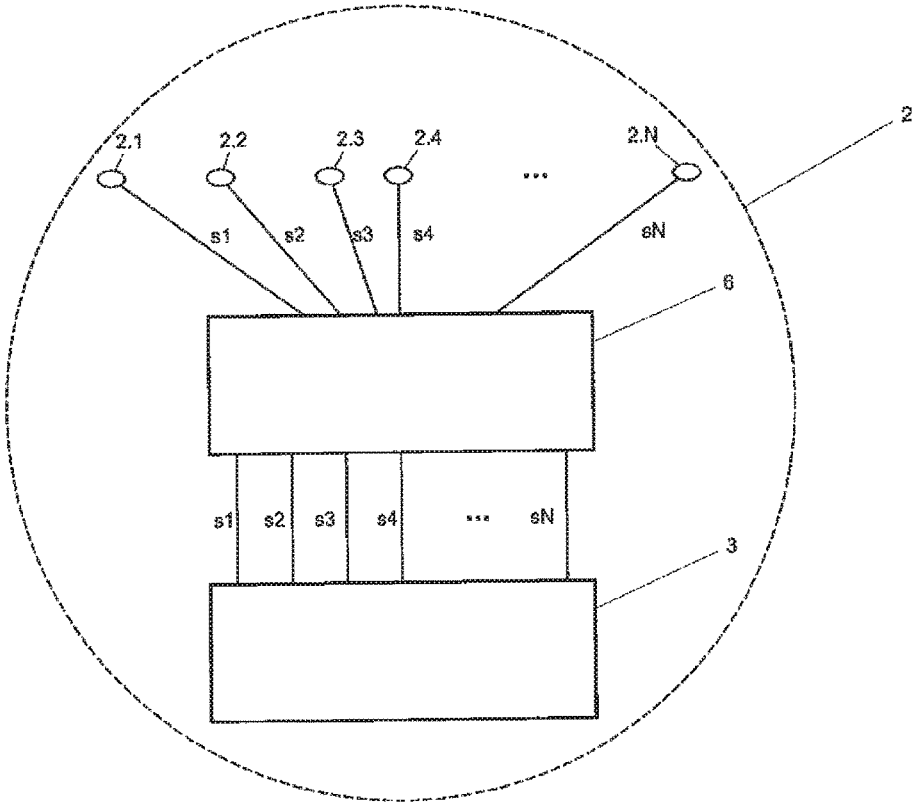

As presented schematically in FIG. 3*a*, the audio sensors 2.1, 2.2, 2.3, 2.4, 2.N are connected to the acquisition unit 3 via a connection board 6.

Figure 3B:
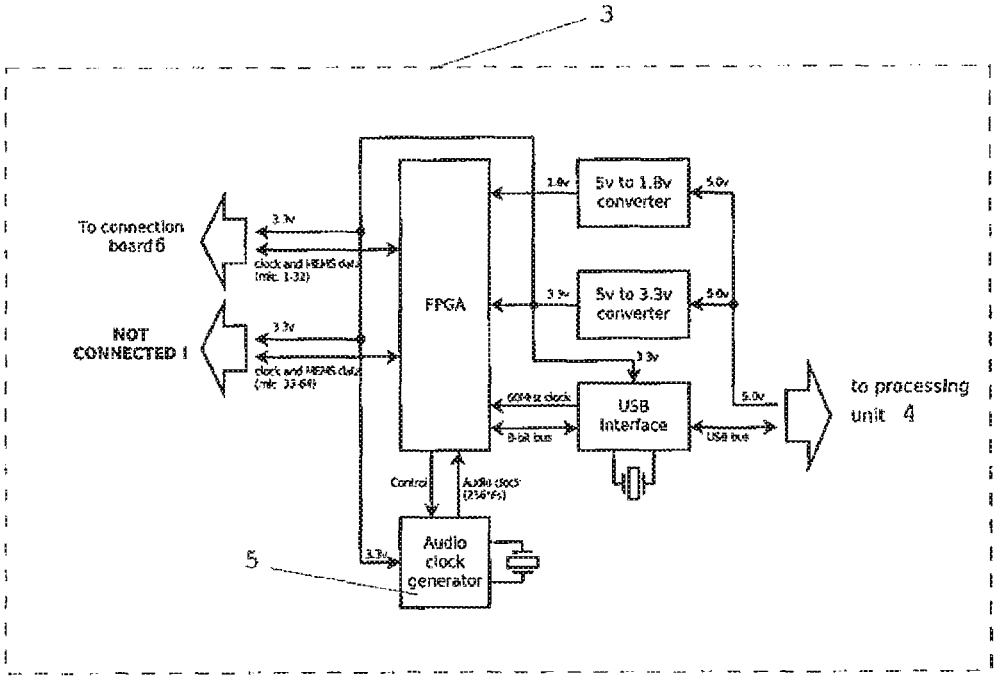
Figure 3C:
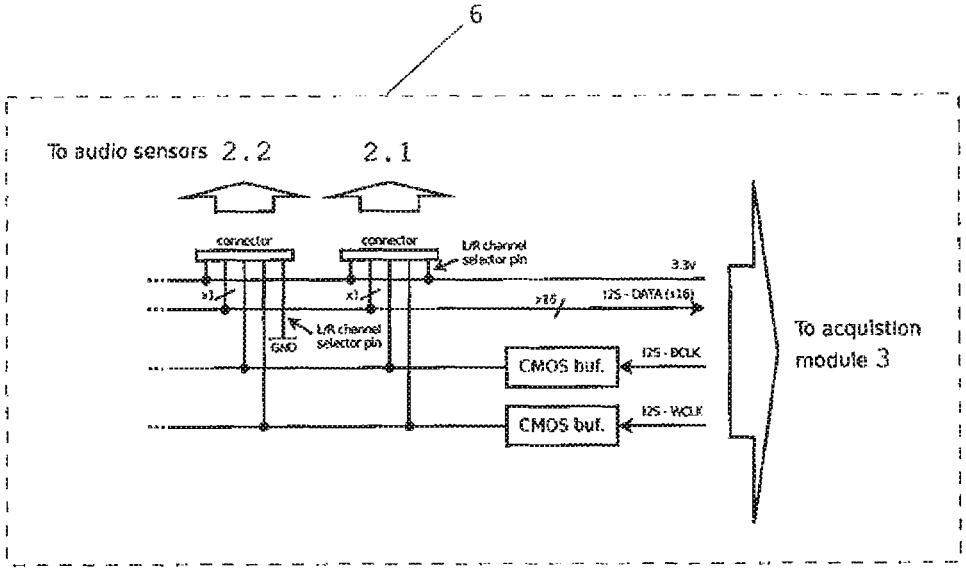
Figure 3D:
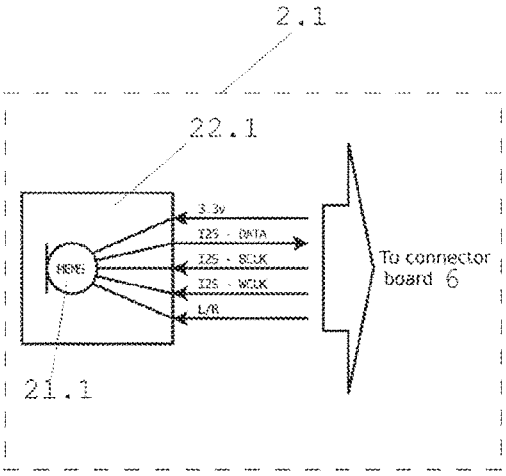

The audio sensors 2.1, 2.2, 2.3, 2.4, 2.N comprise MEMS microphone elements InvenSense ICS-434342 providing 24 bit audio samples with sampling frequency of f, provided by a clock module 5 connected to the acquisition unit. Sampling frequency is selected from the range of 8÷96 kHz. Any of the typical values of 8000 Hz, 11025 Hz, 16000 Hz, 22050 Hz, 24000 Hz, 32000 Hz, 44100 Hz, 48000 Hz, 96000 Hz can be used. Experiments made by the inventors have shown that beamforming gives better results for higher sampling frequencies, preferably above 40000 Hz. The acquisition unit 3 comprises an FPGA unit with 16-bit logic mounted on a second printed circuit board with peripherals as shown in FIG. 3*b*. The acquisition unit 3 is connectable to a processing unit 4, which can be a personal computer or other processing unit, via USB interface. Between the audio sensors and the acquisition unit 3 the connection board 6 is provided as shown in FIG. 3*a*. The connection board 6 is shown schematically in FIG. 3*c*. The InvenSense ICS-434342 MEMS microphone elements are adapted to communicate with I2S interface in a stereo mode. There are two MEMS microphone elements sharing a frame of I2S data line. The first part of the I2S frame corresponds to the first I2S channel while the second part of the I2S frame corresponds to the second I2S channel. I2S channel selection is done with a I2S channel selector pin which may be connected either to the ground or to a power supply as shown in FIG. 3*c*. The I2S channel corresponding to every MEMS microphone element being a part of the audio sensor 2.1, 2.2, 2.3, 2.4, 2.N can be selected on the connection board 6 during assembly of the probe 1 with I2S channel selector pin. That makes grouping the signal from mono microphones into I2S frames of stereo standard easier and reduces the risk of errors resulting in matching wrong MEMS microphone element to wrong signal.

Also such configuration makes it easy to use two or more MEMS microphone elements per one sensor location and increase SNR by averaging their signals or other more advanced processing techniques. This way also directivity of sensor can be increased.

It should be noted that the FPGA unit used in the acquisition unit 3 uses 16-bit logic, as opposed to the 24-bit logic of the MEMS microphone elements. Hence, a conversion is required. It is done as follows:

- Write a sample into a buffer setting bits from 0 to 23 with the bits of the sample and setting bits 24 to 31 with the value of the sample's most significant bit $23^{rd}$—a sign bit—the one most to the left.
- Apply a gain by shifting the bits of the buffer to the left by given number of positions.
- Detect saturation when either bit $31^{st}$ is "1" while bits 24 to 30 of the buffer are all filled with "0" or when bit $31^{st}$ and bits 23 to 30 are filed with "1".
- Return either saturation information or the value of the bits 15 to 31 of the buffer as a return value.

That approach can be generalized to any combination of $B_S$-bit sample X and $B_F$-bit logic of the acquisition unit, when $B_S > B_F$. The method may be denoted as follows:

1. Expand the $B_S$-bit word of sample X with replication of sign to $2B_S - B_F$ word temp:

temp[Bs: $2B_S - B_F - 1$]=X[$B_S - 1$]

temp[0:$B_S - 1$]=X[0:$B_S - 1$]

"x:y" denotes a vector comprising bits from the x-th one to the y-th one,

2. Apply gain by shifting bits to the left:

temp=temp<<G where gain is equal to $2^G$ and G is a number selected from 0 to $(B_S - B_F - 1)$.

3. Return either saturation information or the value of the bits form $(B_S - 1)$ to $(2B_S - B_F)$ of the buffer "temp" as a return value. Saturation is detected when either temp[$2B_S - B_F - 1$]==0 and temp[$B_S - 1$:$2B_S - B_F - 2$] !=0, which implies plus sign saturation or temp[$2B_S - B_F - 1$]==1 i temp[$_s - 1$:$2B_S - B_F - 2$] !=1, which implies minus sign saturation.

The probe 1 according to the present invention has 32 MEMS audio sensors in total. They are arranged in such a way that they form apexes of a body highly resembling a pentakis dodecahedron. However, as it is impossible to circumscribe a sphere on all pentakis dodecahedron apexes, the ones laying below or above spherical surface are shifted along sphere radius to this surface. Hence, all audio sensors are lying on the spherical surface of the body 2. A method of distributing audio sensors on a sphere was disclosed by P. Santos, G. Kearney and M. Gorzel in "Construction of a Multipurpose Spherical Microphone Array", ESMAE—IPP, 7-8 Oct. 2011.

Every array of audio sensors has its cut-off frequency above which beamforming results in additional interference—so called spatial aliasing. The in the spatial domain the cut-off frequency is equal to 1/(2d), where d stands for the distance between the audio sensors. This frequency $$f_{spat} = \frac{1}{2d},$$

is expressed in [1/meter]. All frequencies above this limit are biased with so called aliasing effect which causes irregularities in directivity characteristics. Sound spatial aliasing cut-off frequency $f_{cutoff}$ expressed in Hz and corresponding to this spatial frequency can be calculated when speed of sound c in the medium is known: $f_{cutoff}=f_{spat}\cdot c$. In the air, the speed of sound is approximately 340 [m/s].

When the radius of the sphere forming the body 2 of the probe is 52.5 mm. Given that there are 32 microphones, the cut-off frequency of the probe is approximately 6 kHz. Above this value spatial aliasing is a significant obstacle against effective beamforming. Spatial aliasing is determined by the distance between neighboring sensors. Hence, there are two relatively simple solutions to mitigate it either reduce the radius of the sphere or use more sensors.

European patent application EP 2773131 A1 discloses a spherical microphone array with improved frequency range for use in a modal beamformer system that comprises a sound-diffracting structure, e.g. a rigid sphere with cavities in the perimeter of the diffracting structure and a microphones located in or at the ends of said cavities respectively, where the cavities are shaped to form both a spatial low-pass filter, e.g. exhibiting a wide opening, and a concave focusing element so that sound entering the cavities in a direction perpendicular to the perimeter of the diffracting structure converges to the microphones, e.g. by providing a parabolic surface, in order to minimize spatial aliasing. Application of the solution according to the EP 2773131 A1 is limited by the fact that the depth of the cavities is limited by the size of the sphere which has to contain also other electronic equipment and by the size of the audio sensor as conventional microphone sensors are rather large and hence difficult to locate in the small focal point of the cavity.

Microphone probe according to the invention offers yet another way to at least partly solve this problem. Directivity of the MEMS audio sensors appear to be increased at higher frequencies due to the shape of the hemispherical recesses 11.1, 11.2, 11.3 11.N and due to an additional sound conduit formed along the thickness of the PCB, namely the openings 12.1, 12.2, 12.3, 12.N. That additional sound conduit in combination with the shape of the cavity, at higher frequencies offers significantly higher directivity of a single digital audio sensor 2.1, 2.2, 2.3, 2.4, . . . , 2.N. Hence, in the high part of the sound bandwidth the beam of a single sensor is narrow enough to select a sound source formed by a single instrument in a musical band. The directivity of a single sensor placed in the hemispherical recess increases at high frequencies. That means that increase of directivity corresponds to the frequency bands above spatial aliasing cut of frequency. That makes recording possible even when spatial aliasing affects conventional beamforming.

Other mechanical structures increasing directivity can also be applied. Similar approaches were used in parabolic microphones or Neumann TLM 50 microphone.

Microphone probe having 32 audio sensors offers 32 possibility of selection from 32 directivity patterns. On high frequencies these directivity patterns are elongated and referred to as beams. It should be stressed that directivity pattern of the whole probe 1 in which one audio sensor have been selected can be slightly tuned with a use of sound signals received with adjacent sensors added and aligned in phase but with smaller weights. Consequently, even when the mode of processing above upper frequency limit is changed from typical beamforming to audio sensor selection it is still possible to slightly tune the directivity pattern.

The audio sensors are distributed on a sphere in a latitude manner. One of the directions, in examples below denoted as Z, is distinguished. The audio sensors are distributed in layers spaced in the Z direction. The highest and the lowest layer always contain only one single audio sensor. The middle, center layer contains maximal number of audio sensors. Under this constrains there is a number of approaches towards selecting number of audio sensors per layer and a relative distance and rotation of the layers.

The distances between the layers can be selected based on either angular or linear approach. In the angular approach, the layers are uniformly distributed in the domain of latitudes, i.e. latitudes of adjacent layers differ always by the same angle. In the linear approach, the distances between layers in the Z direction are equal.

The relative rotation of adjacent layers is selected so that the audio sensors in one layer were located at the longitudes of centers of the gaps between the audio sensors in adjacent layers. That allows more effective use of the surface of the body 2.

In the embodiment with the spherical shape the linear approach results in higher density of the audio sensors in the central region of the body 2. That in turn gives better separation of the sources located in an elevation in the plane corresponding to 0 degrees—i.e. the horizontal one. On the other hand, the angular approach results in more uniform quality of beamforming in the whole range of elevation angle.

Figure 4A:
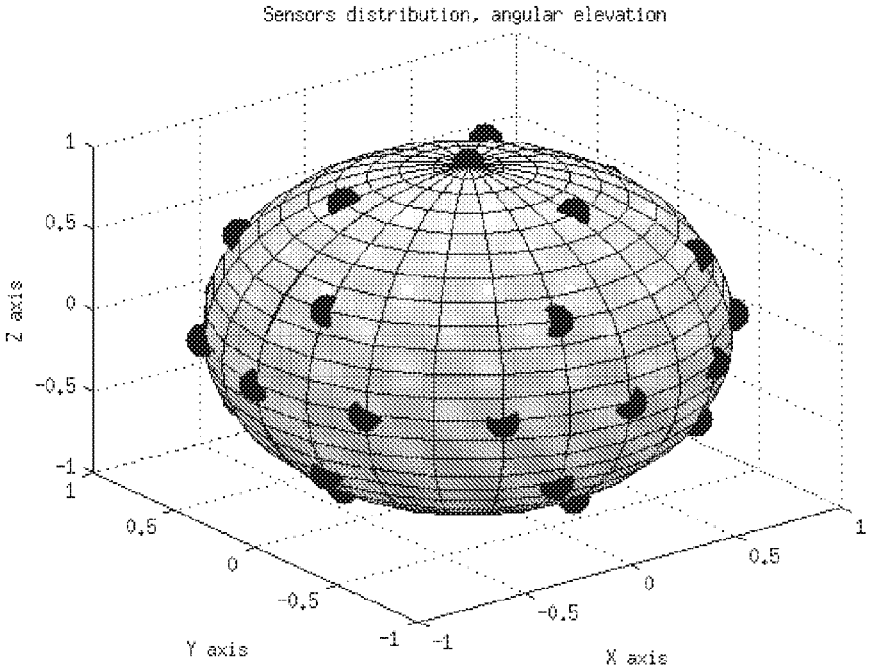
Figure 4B:
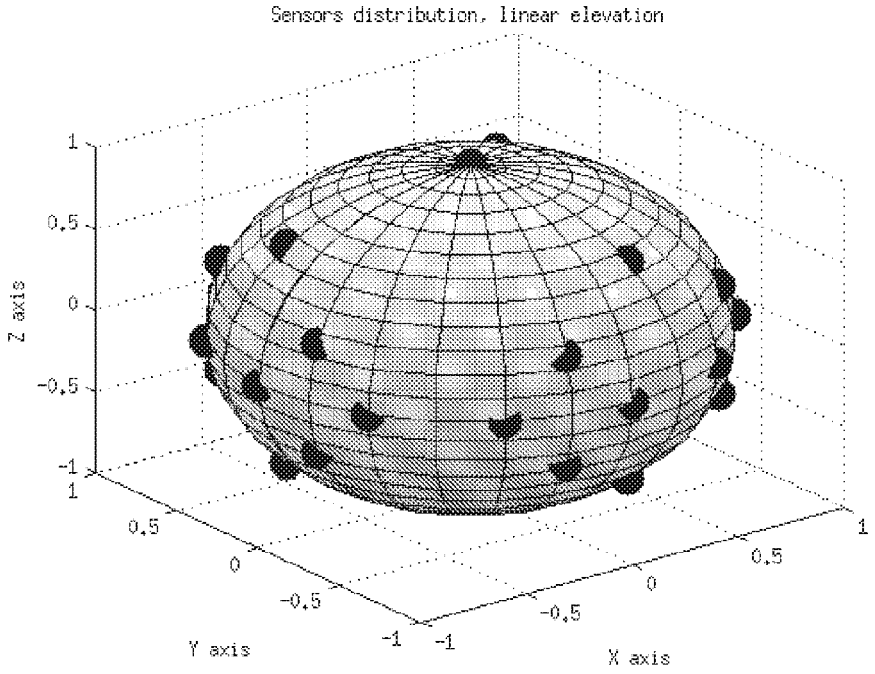

Exemplary distribution of 32 audio sensors in 7 layers including [1, 3, 6, 12, 6, 3, 1] audio sensors, respectively, with the angular distribution of layers is given in FIG. 4*a*. The same layers distributed linearly are presented in FIG. 4*b*.

Figure 4C:
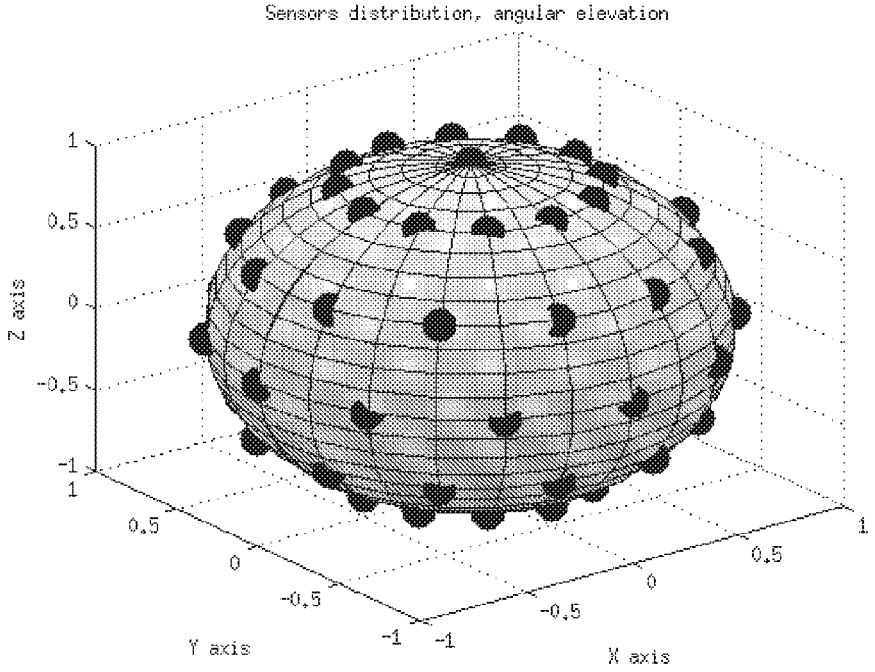
Figure 4D:
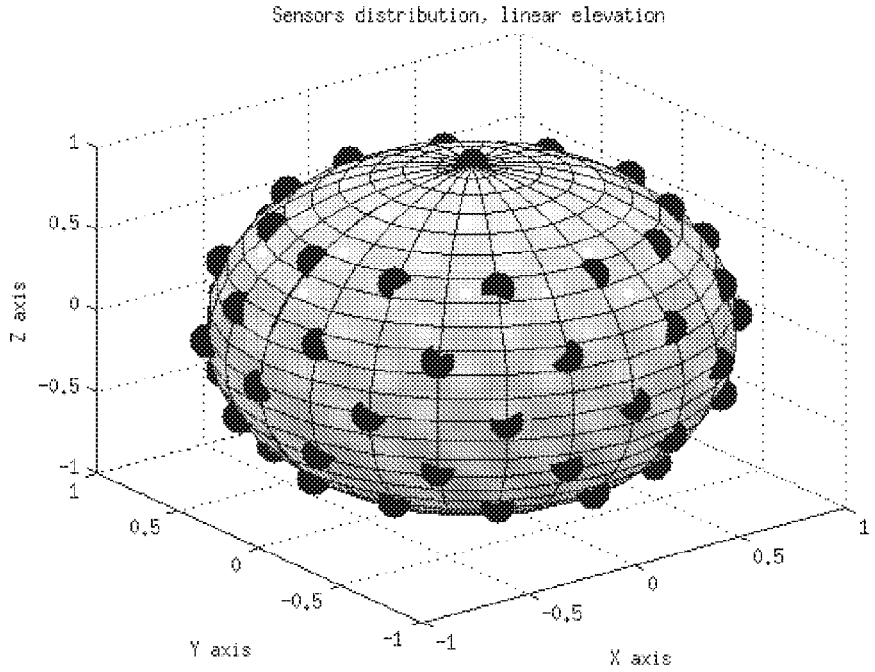

FIG. 4*c* presents a distribution of 62 sensors onto 7 angularly distributed layers including [1, 12, 12, 12, 12, 12, 1] audio sensors, respectively. FIG. 4*d* presents the same layers distributed linearly.

It should be noted that thanks to the small dimension of the MEMS audio sensors, the total number of audio sensors can be further increased. That allows more precise determination of the direction of arrival and increases spatial aliasing cut-off frequency.

Figure 4E:
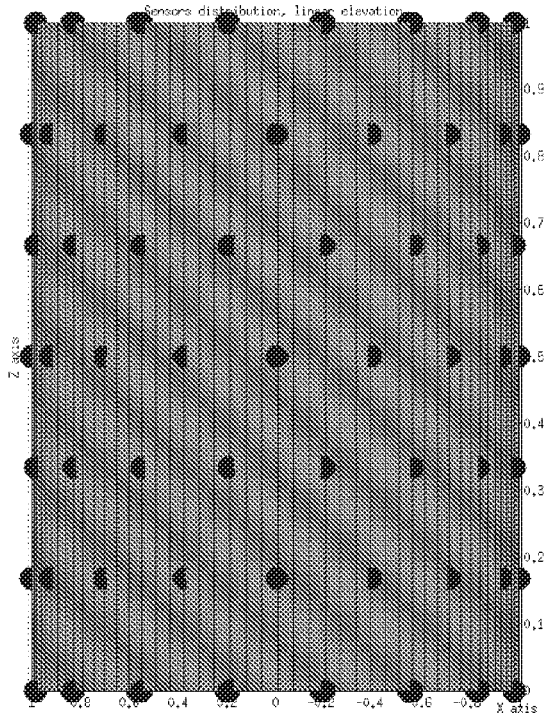

In an alternative embodiment, the body 2 is cylindrical and the MEMS audio sensors are distributed on its latter surface. The radius of the cylindrical body is 57.3 mm and the height is 78 mm. The sensors are distributed in 7 layers with 24 sensors per layer. Adjacent sensors are spaced by 15 mm one from each other, forming a mesh of equilateral triangles with sensors in vertices. The above distribution of sensors is illustrated in FIG. 4*e*.

Figure 5:
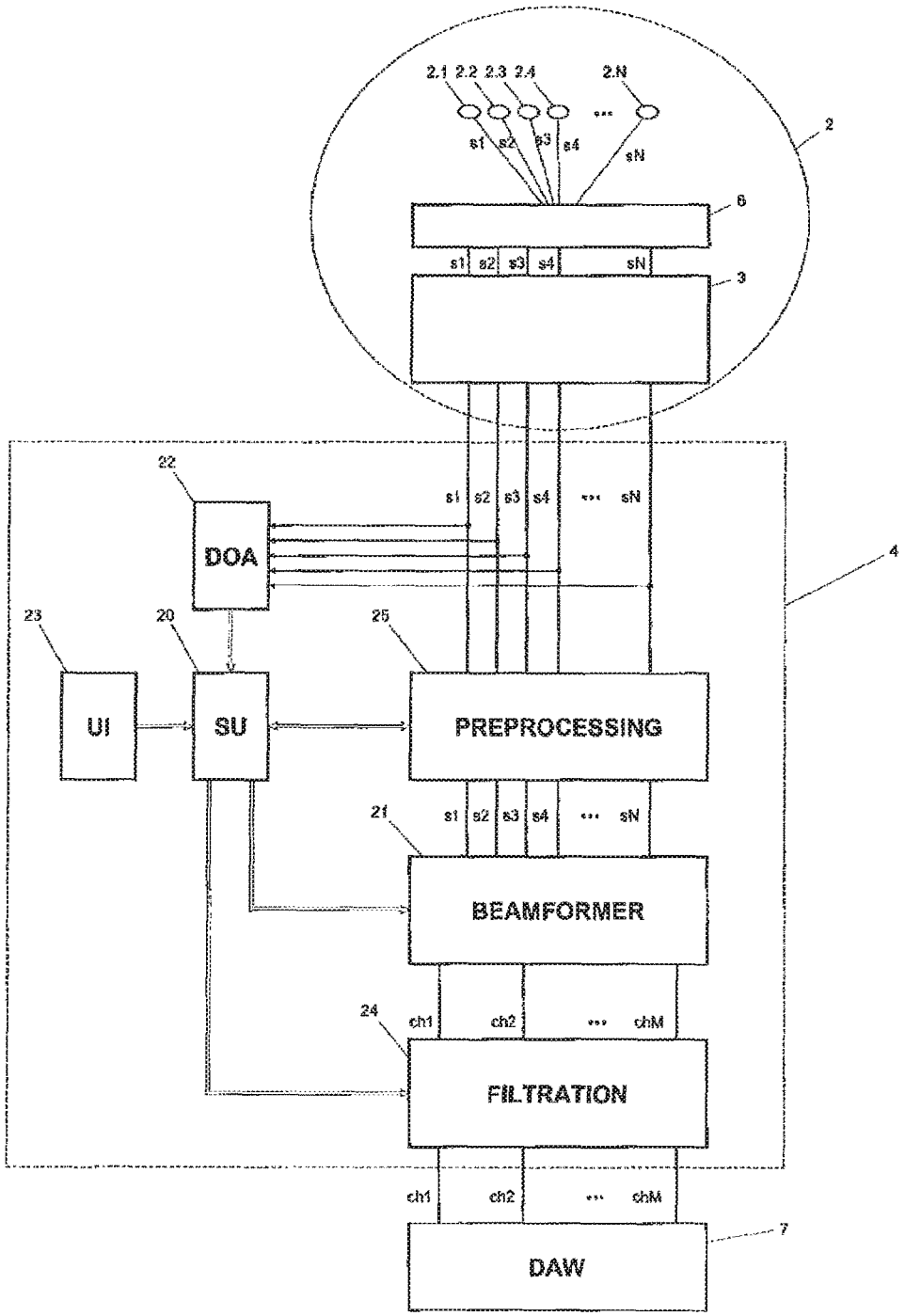
FIG. 5 shows a block diagram of an embodiment of the system according to the invention.

An embodiment of the audio recording system adapted to execute a method according to the invention is presented in FIG. 5. In this embodiment, the method according to the invention comprises the first step of acquisition of N signals {s1, s2, . . . , sn, . . . , sN} from N audio sensors 2.1, 2.2, . . . , 2.N. This step is realized by a probe 1 according to the invention. The second step is executed by the processing unit 4 consists in determining locations of M sources of the sound, that is in the direction of arrival analysis. Further steps are executed by the processing unit 4. The third step involves applying beamforming to obtain M channels ch1, ch2, . . . , chM, each corresponding to one of the M sources. Finally, postprocessing filtration step is executed.

Once signals from audio sensors are acquired, the method according to the embodiment of the invention is executed by the processing unit 4 having following blocks implanted in hardware or software: preprocessing block 25, beamforming block 21, and filtration block 24, presented in FIG. 5. Beamforming block 21, whose function is referred to as beamformer, is fed with N signals s1, s2, . . . , sN from the probe 1 having N sensors 2.1, 2.2, . . . , 2.N. N in this example is equal to 32. The beamformer applies an M×N table of filters to obtain M channels ch1, ch2, . . . , chM corresponding to the M sources of sound.

The signals from the M channels are processed in filtration module 24. Parameters and essential features of the filtering process are adaptively changed by a steering unit 20 computing statistics of respective sources, communicating with user interface, UI block 23 and with Direction of Arrival, DoA block 22. DOA block is fed with signals s1, s2, . . . , sN to perform direction of arrival analysis and provide it to steering unit 20. Steering unit 20 is adapted to present the directions of arrival to user and optionally receive indication of the relevant ones as well as source specific information from UI block 23. Source specific information is utilized in preprocessing block. The number and location of sources fed to the beamforming block 21. Beamforming block 21 is adapted to form M channel corresponding to M sources. Finally, processed samples in the channels ch1 . . . chM are ready fed to the Digital Audio Workstation i.e. DAW software—DAW block 7.

According to the invention there are two basic configurations of this system. In the first configuration the processing unit 4 is integrated with the probe 1. In fact, it is implemented in the same FPGA unit that acts as the acquisition unit 3. In the second configuration whole processing unit is implemented in the computer system only connected to probe 1. This computer system preferably has already implanted DAW block 7.

Direction of Arrival Analysis

The direction of arrival analysis is executed by the DOA block 22. There is a number of state of the art methods applicable for the direction of arrival analysis applied in the method and system according to the invention. The one below is given by the way of example including some unique modification. The DOA analysis is based on the part of the frequency spectrum of the input signals s1, s2, . . . , sN below the spatial aliasing cut-off frequency. Namely, it is the lower part of STFT spectrum which is taken into account in the analysis.

That approach is successful also in localizing instruments, even though some of them operate in rather high frequency band. Usually, even when sound of the instrument occupies rather high frequency band some components have small amount of energy and are detectable at frequencies below spatial aliasing cut-off frequency.

An example of DoA operation is so called WDO approach described by O. Yilmaz and S. Rickard in "Blind separation of speech mixtures via time-frequency masking," in IEEE Trans. Signal Process., vol. 52, no. 7, pp. 1830-1847, July 2004.

A wideband variation of MUSIC algorithm is described by S. Argentieri and P. Danés in "Broadband variations of the MUSIC high-resolution method for sound source localization in robotics," in Proc. IEEE/RSJ Int. Conf. Intell. Robots Syst. (IROS), November 2007, pp. 2009-2014.

Independent Component Analysis-Generalised State Coherence Transform (ICA-GSCT) algorithm is disclosed by F. Nesta and M. Omologo in "Generalized state coherence transform for multidimensional TDOA estimation of multiple sources," in IEEE Trans Audio, Speech, Lang. Process., vol. 20, no. 1, pp. 246-262, January 2012.

Particularly well results were obtained with application of constant-time analysis zone algorithm described by D. Pavlidi, A. Griffin, M. Puigt, and A. Mouchtaris in "Real-Time Multiple Sound Source Localization and Counting Using a Circular Microphone Array", in IEEE Trans. Audio, Speech, Lang. Process., vol, 2, no. 10, October 2013.

The core stages of the method proposed therein are:

1) Application of a joint-sparsifying transform to the observations, using the Time-Frequency transform.

2) The single-source constant-time analysis zones detection.

3) The DOA estimation in the single-source zones.

4) The generation and smoothing of the histogram of a block of DOA estimates

5) The joint estimation of the number of active sources and the corresponding DOAs with matching pursuit, which consists in analysis of the generated DOA histogram and finding contribution from sources, then removing them and repeating whole process until remaining sources become insignificant. The possible criterion for rendering the source insignificant trigger values for respective sources are aligned in vector indicated below as GAMMAj. Typically trigger value is equal to 0,1.

The above cited paper describes the method in detail and in a such a manner that it can be easily repeated by the person skilled in the art. However, it should be noted that the inventors have introduced two advantageous modifications.

The first modification consists in amending the matching pursuit algorithm by replacing the fixed Blackman window width used for removing the source contribution with iterative selection of the Blackman window width, so as to obtain minimum value of the histogram energy remaining after removing the source contribution.

The second modification concerns trigger value of the source contribution factor. Instead of using fixed values, an adaptively determined value is applied. An arbitrary value is used only for the first source detection. In all further repetition of finding contributions from sources and removing them, a value of GAMMAj is selected on a base of the ratio between the normalized source energy and the normalized histogram energy. Reasonable results were obtained for GAMMAj values being mean values of such ratios for all previously detected and removed contributions.

In an alternative embodiment, the direction of arrival analysis may be reinforced or even replaced by prompting user with user interface and letting the user to select the sources. The later may be advisable if distribution of sources and the probe 2 within the room is repeatable. Such circumstances can be advantageous and open a possibility of improving the quality of recording with preprocessing including deconvolution of link impulse response determined with in that situation can be determined with additional measurements.

The direction of arrival analysis may be reduced merely to prompting user with user interface to enter location of sources and—optionally—parameters of these sources. These parameters may include in particular frequency band occupied by a source and/or the type of a source, e.g. drums or vocal.

Alternatively, when user enters locations and parameters of the sources, the direction of arrival analysis presented above is used to track the subsequent changes of location.

Preprocessing

Figure 6:
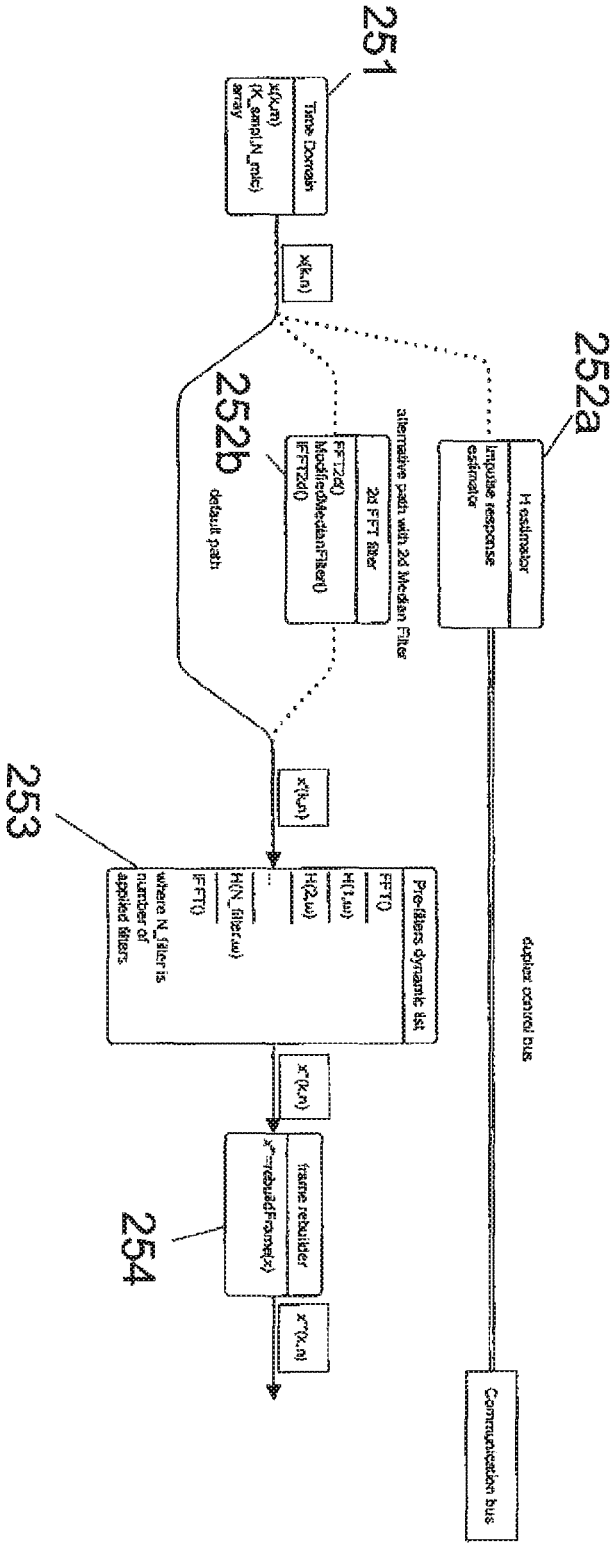
FIG. 6 shows a flow chart of the method executed by the preprocessing block.

Preprocessing is an optional step. It is executed only in some embodiments of the invention. The functional block diagram of the preprocessing block 25 is presented in FIG. 6. Alternative paths are selected by a user and based on his estimation of the recording conditions.

Firstly, N input signals are divided into frames of K samples in the time domain block 251. If not specifically explained otherwise the frame length is 2048 samples in all the examples given in this specification. Hence, here K=2048.

The H-estimator is used for estimation of the parameters of the link in the propagation environment. It requires an additional source of noise-like reference signal used prior to recording music. This source is subsequently located in destined locations of the sources to be recorded.

For every single source location, the H-estimator 252*a* accepts a matrix of K-samples waveforms from N microphones and provides estimated impulse response to the steering unit 20 and the beamforming block 21 via a dedicated communication bus for further use during actual recording of sound. The impulse responses can be deconvoluted from signals corresponding to the particular sources to compensate the effect of environment on the sound, including cancelation of echo. Additionally impulse responses are optionally used in beamforming by providing indication of the expected directions of arrival of the loudest reflected signals which are then cancelled in the beamforming block 21. Processing according to the paper by Jacob Benesty "Adaptive eigenvalue decomposition algorithm, for passive acoustic source localization," in J. Acoust, Soc. Am. 107 (1), January 2000, is applied in this example.

The 2d FFT filter block 252*b* is used optionally for elimination of interferences that are typical for MEMS audio sensors. It is a 2D median filter.

The pre-filters dynamic list block 253 comprises a sequence of filters used for individual correction of the signals from digital audio sensors 2.1, 2.2, 2.3, 2.4, 2.N with coefficient determined in a calibration—a process known from the art and not described herein. Alternatively, lowpass filters can be used. Filtration is executed in the frequency domain. Frames are transformed with Fast Fourier Transform and then multiplied by filter transfer function $H(n,\omega_i)$ where $n\in\{1, \ldots, N\}$. The ones skilled in the art know multiple ways for selection shapes of $H(n,\omega_i)$ suitable for the given sensors' properties and interferences in the environment.

Finally, the frames are rebuilt in the frame rebuilder block 254.

Beamforming

The beamforming block 21 is responsible for synthetizing multiple directivity patterns of the probe 1, each corresponding to particular channel. A directivity pattern is a function describing the ability of the probe 1 to respond to audio signals arriving from a given direction. The directivity pattern depends also on the frequency of the signal. In practice it is represented as a function of direction—a pair of angles in azimuth and elevation $(\varphi,\theta)$, respectively, as well as a function of frequency f or pulsation $\omega$, where $\omega=2\pi f$. This function can be designed by to optimize reception of the signal having particular frequency spectrum and origin located in particular place in space.

The general problem of audio sensor array beamforming described in detail in section 5.1 of a book by Boaza Rafaely "Fundamentals of Spherical Array Processing", Springer Topics in Signal Processing Volume 8, ISBN 978-3-662-45664-4, can be defined as a problem of designing vector $w(\omega)$ of weights, $w(\omega)=[w_1(\omega),w_2(\omega), \ldots, w_n(\omega), \ldots, w_N(\omega)]^T$, such that, for a given array input $s(t)=[s_1(t), s_2(t), \ldots, s_n(t), \ldots, s_N(t)]^T$, the audio sensor array output ch (t) is produced with some desired properties, where:

$$Ch(\omega)=w^H(\omega)\cdot s(\omega)$$

and where N is a number of the audio sensors, $n\in\{1, \ldots, N\}$ is a variable used to index them, vector $w^H(\omega)$ stands the conjugate transpose of $w(\omega)$, $S(\omega)$ represents a vector of complex amplitudes a pulsation $\omega$ of the sound signal received by all audio sensors $S(\omega)=[S_1(\omega), S_2(\omega), \ldots, S_n(\omega), \ldots, S_N(\omega)]^T$, $Ch(\omega)$ represents complex amplitude at pulsation $\omega$ of the beamformer output sound signal. From the above it is clear that beamforming is done in the frequency domain in a frame-by-frame manner and that:

$$S_n(\omega)=F\{s_n(t)\}$$

$$ch(t)=F^{-1}\{Ch(\omega)\}$$

In the system according to the present invention the problem has one additional dimension as there are at least two outputs—each corresponding to different source. In the frequency domain output channels are represented by vector $Ch(\omega)=[Ch_1(\omega), Ch_2(\omega), \ldots, Ch_m(\omega), \ldots, Ch_M(\omega)]^T$, where M is a number of channels produced by the beamforming block 21 and $m\in\{1, \ldots, M\}$ is used to index them. Following notation used in FIG. 5, let us denote the number of sources as M and index of sources as m. Accordingly, and taking into account that digital processing with discrete a values indexed with a variable i is used beamforming equation for the m-th channel is:

$$Ch_m(\omega_i)=w_m{}^H(\omega_i)\cdot S(\omega_i),$$

where $w_m(\omega_i)$represents vector of weights corresponding to m-th channel. That means, that in single beamforming operation M directivity patterns are applied to obtain M respective channels by applying matrix $w^H(\omega_i)$ of weights formed of the rows corresponding to respective channels:

$$Ch(\omega_i)=w^H(\omega_i)\cdot S(\omega_i),$$

It should be stressed that above formula represents amplitudes corresponding to a given pulsation discrete values $\omega_i$, a given frame, hence $Ch(\omega_i)$, and $S(\omega_i)$ are representations of the signals in frequency domain, calculated for this frame.

According to one embodiment of the invention for the values of $\omega_i$, corresponding to frequencies below spatial aliasing cutoff frequency—

$$\frac{\omega_i}{2\pi} < f_{cutoff}$$

—beamforming block 21 operation consists in determining and applying filter from table of filters $w^H$. The beamforming block 21 is adapted to operate in four modes described below. It should be stressed that in order to evaluate condition $$\frac{\omega_i}{2\pi} < f_{cutoff}$$

sampling frequency must be known. It has to be explicitly stored as in the numerical analysis frequency is normalized to the sampling frequency fs. Only then it is possible to identify values of i, for which $\omega_i$ does not meet this condition. Above $f_{cutoff}$ conventional beamforming not applied. What is done instead is selection of signal from single sensor. Due to the fact that sensors are located in cavities 11.1, 11.2, 11.3 with further contribution of opening 12.1 in PCB board on frequencies above spatial aliasing cutoff frequency digital audio sensors have own directivity pattern in a form of a beam narrow enough to select single instrument form a musical band.

Consequently signals in the respective channels in the system according to the invention have frequency domain representation obtained with beamforming below spatial aliasing cutoff frequency and sensor selection above spatial aliasing cutoff frequency. That results in very effective extraction of the signals from given sources even when frequency band of the source covers spatial aliasing cutoff frequency. For the m-th source located in direction $(\varphi_m, \theta_m)$ and for the value of pulsation $\omega_i$:

$$\begin{cases} Ch_m(\omega_i) = w_m^H(\omega_i)\cdot S(\omega_i) & \frac{\omega_i}{2\pi} < f_{cutoff} \\ Ch_m(\omega_i) = S_n(\omega_i) & \frac{\omega_i}{2\pi} \geq f_{cutoff},\ n \text{ selected as closest to } (\phi_m, \theta_m) \\ ch_m(t_k) = IFFT(Ch_m(\omega_i)) & t_k \text{ represents discrete time} \end{cases}$$

Let us now refer to modes of beamforming block operation below spatial aliasing cutoff frequency.

I. Constant Gain Per Channel Mode.

Beamforming block 21 in this mode provides constant gain in a given direction remaining directions are minimized. In this mode beamforming block 21 may or may not use input of DOA block 23 to locate the sources.

Without this support it is user who provides M arbitrarily given directions via user interface UI block 23. Coordinates are communicated to the beamforming block 21 via steering unit SU 20. Beamforming block 21 further operates to maximize signal to interference ratio in M channels corresponding to results of M beamformers steered to M given directions.

In cooperation with the Direction of Arrival block it is the DOA block 22 what is used to identify the directions of arrival and types of sources. The results are communicated to SU 20 and displayed in the circular diagram with the UI block 23. User is prompted to select and possibly manually tune the autodetected directions. The beamforming block 21 further operates to maximize signal-to-interference ratio in M channels corresponding to M given directions. With the support of the DOA block 22, the user selects with the user interface the directions of sound sources and assigns attributes thereto.

Minimal angular step of direction depends on the step used while creating the table of filters and typically is in the range of 1 to 5 degrees.

Denoting correlation matrix of the acoustic field sampled by the audio sensors as $S_{xx}$, a matrix of constrains of size N×M by V, and a vector of gains for particular channels of size 1×M by c, the beamforming applied in this mode is a solution to the following optimization problem:

$$\begin{cases} \underset{w}{\text{minimize}}\ w^H \cdot S_{xx} \cdot w \\ \text{subjected to } V^H w = c \end{cases}$$

This is called LCMV beamforming. The principle of designing filter table implementing it is described in section 7.5 of Boaza Rafaely Fundamentals of Spherical Array Processing, Springer Topics in Signal Processing Volume 8, ISBN 978-3-662-45664-4. Minimization criterion is as follows: c is one element vector and V contains one steering vector, as described in subsection 7.55. Formula 7.60 is applied to calculate table of filter weights:

$$w^H = c^H(V^H S_{xx}^{-1})^{-1} V^H S_{xx}^{-1}$$

The correlation of interference is a function of an izotropic noise field. Diffusion of the noise is in the system according to the present invention modelled according to I. A. McCowan, "Robust Speech Recognition using Microphone Arrays,", PhDThesis, Queensland University of Technology, Australia 2001:

$$\Gamma_{ij}(\omega) = \text{sinc}\left(\frac{2\pi d_{ij}}{\lambda}\right),$$

where $$\lambda = \frac{2\pi v}{\omega}$$

is a wavelength of sound propagating with velocity v and corresponding to ω, $d_{ij}$ is the distance between sensors i and j, while $$\text{sinc}(x) \triangleq \frac{\sin(x)}{x}.$$

II. Constant Gain Along Desired Direction Per Channel and Suppression in Other Specified Directions.

The beamforming block 21 in this mode provides constant gain in range <0;1> for a given direction, and suppression of signals coming from one or more unwanted directions that are minimized as described in reference with mode I. Using the UI block 23 user may manually select desired directions and define M corresponding channels, then for every channel may select unwanted directions—the ones corresponding to origins of the signals to be minimized. A use of the DOA block 22 allows for an automatic detection of the directions corresponding to all origins, then the user defines attributes: either desired or unwanted (i.e. interference). The number of channels M is equal to the number of the directions having the attribute set to "desired". Locations of particular sources are tracked in time. Beamforming filters are updated in real time and modified using adaptive signal processing techniques or partially stored in memory in the table of filters.

Criteria for minimization are changed as follows: Sxx is a synthesized correlation matrix between the interfering signals to be minimized. In that mode V contains steering vectors indicating directions that correspond to the signals prescribed to be either attenuated or amplified to precisely prescribed value. For a given direction the gain and supression are constant for all frequencies.

III. Constant Gain Per Channel and at Least One Nullified Source Mode.

In this mode the beamforming block 21 optimizes in a domain including two dimensions—direction and frequency, not only to amplify signal originating from "desired" direction, but also to generate null for the unwanted direction but only for values of $\omega_i$ corresponding to a source marked as unwanted. It should be noted that introducing frequency specific tags could reduce computational power required and is useful in filtration that follows beamforming. Precisely, sources can be assigned additional tags indicating the width of occupied frequency spectrum. Preferably, these tags correspond to the typical audio tracks: "vocal", "violin", "piano", "drums", "flute", "saxophone" etc. Every tag represents particular frequency spectrum occupied by the signal as well as a model of the source of sound, and is used together with direction information.

The beamforming block 21 in this mode is applicable for elimination of reflections of sound from the walls of the room in which the probe is located.

Criteria for minimization are similar to the ones used in mode II, but due to application of tags each frequency is considered independently, and so are correlation matrices, weights, constrains and gains. Namely, the optimization problem for each $\omega_i$ is solved separately:

$$\begin{cases} \underset{w(\omega_i)}{\text{minimize}}\ w^H(\omega_i)\cdot S_{xx}(\omega_i)\cdot w(\omega_i) \\ \text{subjected to } V^H(\omega_i)w(\omega_i) = c(\omega_i) \end{cases}$$

IV. Virtual Microphone with Directivity Shaping Mode

In the virtual microphone mode the beamforming block 21 optimizes directivity pattern of the probe 1 to match a directivity pattern arbitrarily given by the user.

Those skilled in the art are able to implement above modes easily by using LCMV algorithm described in "Fundamentals of Spherical Array Processing" by Rafaely Boaza, sections 7.6, 7.7, and 7.8, and "Design of Circular Differential Microphone Arrays" by Jacob Benetsy.

Optional but advantageous modification of operation of the beamforming block 21 consists in applying additional weights to the sensors prior execution of the beamforming operations indicated above. Distribution of weights depends on the source towards which the beam is supposed to be directed, as schematically illustrated in FIG. 7*a*. The dark color represents greater weights applied to the audio sensors, the bright one represents lower weights. As it is apparent from FIG. 7*a*, this approach lets the sensors directed towards source and not shadowed by the body 2 of the probe 1 have greater contribution to the resulting channel corresponding to this particular source.

An additional advantageous embodiment of the beamforming operation is related to a use of single MEMS microphone elements as audio sensors. Small dimension of MEMS microphones makes it possible to use 32 or even more, preferably 62 digital audio sensors on a sphere. Locating sensors more densely contributes to increase of spatial aliasing cut-off frequency, allows for using sensors having higher directivity and narrower beam of directivity pattern, but on the other hand may cause problem due to limited precision of the sensor location.

There is a strong dependence between properties of the interference correlation matrix and noise on the output of the beamformer. White noise gain can be controlled algorithmically and geometrically. In the present invention the level of white Gaussian noise is estimated according to the I. A. McCowan, "Robust Speech Recognition using Microphone Arrays", PhD Thesis, Queensland University of Technology, Australia 2001. Consequently, a constrain on weights w is applied according to the formula:

$$\frac{|w^H\cdot k|^2}{w^H\cdot w} = \sigma^2$$

where k is a propagation vector and $\sigma^2$ is a value not lower than minimal acceptable SNR.

This formula is true under the condition that each sensor has the same noise and the location of the sensor is precise. The latter can be assumed true when the spaces between sensors are greater or equal than 0.1 of the wavelength.

That approach allows denser distribution of the audio sensors 2.1, 2.2, 2.3, . . . , 2.N on the surface of the body 2 of the probe 1. Namely, it enables increasing N without increase of the dimensions of the body 2. In advantageous example the beamforming block 21 operates in 3 sub-bandwidths. For each of the sub-bandwidths different subset of digital audio sensors is used. Consequently, at lower frequencies with longer wavelengths the spacing between particular audio sensors is greater. As frequency is increased, more audio sensors are selected and effectively the spacing between the sensors used is lower. A table indicating constrains for sensor selection is presented in FIG. 7*b*.

In an alternative embodiment a different beamforming principle is applied. It requires an initial measurement of the properties of the probe 1, i.e. the probe characterization that results in obtaining a frequency response matrix H(ω) of size N×L. Each element of the matrix comprises a Fourier transform of the impulse response of particular sensor corresponding to particular direction of arrival. N is a number of sensors and L is a number of directions of arrival. In further description beamforming is done on a frequency-by-frequency basis. Sole symbol H denotes then N by L samples corresponding to a single frequency and consequently a single value of ω.

Using the measured frequency response matrix H has an advantage over use of is the synthesized correlation matrix Sxx and LCMV algorithm described above in that the Sxx matrix results from purely geometrical calculations done over the given geometry of the sensors of the probe 1 and under the assumption that sound propagates in a linear manner. Moreover, the results are susceptible to errors caused by production misplacement of the sensors that can be difficult to detect. On the other hand, a use of the frequency response matrix H requires individual characterization of every probe 1 that is produced, which is time consuming and requires an anechoic chamber. In this respect simplicity is an advantage of using the synthesized correlation matrix.

The probe characterization procedure consists in locating a source of sound in a number of locations with respect to the probe 1 and recording responses of all N digital sound sensors present on the probe. It has to be done in an anechoic chamber to guarantee a single line of propagation of sound. When the probe 1 is located on a platform revolving in the vertical plane in an anechoic chamber in front of nine computer-controlled sources of sound, it is possible to record responses of the probe 1 on the 3D distribution of sources. Relative distribution of the sound sources with respect to the center of the probe 1 is shown in FIG. 7*c*. The result of the procedure is a matrix having one dimension corresponding to N sound sensors and the other one corresponding to the number L of relative locations of the sound sources. Measurement scheme for a single impulse response is disclosed in "IMPULSE RESPONSE MEASUREMENTS BY EXPONENTIAL SINE SWEEPS" by Angelo Farina. A frequency spectrum is obtained from an impulse response with the Fourier transform, preferably FFT.

Once the frequency response matrix is determined, determining and applying the filter table $w_m^H(\omega)$ is required for completing beamforming operation for every value of ω. The filter table elements $w_m^H$ naturally depends on a frequency, but operations are done with the same principle for all frequencies and hence dependence on a frequency can be omitted in presented operations.

For given ω and for the m-th channel the values of the filter table are determined according to the formula:

$$w_m = \frac{H^H g_m}{H^H H + \beta I}$$

where I stands for an identity matrix and β is selected to improve the numerical conditioning of the equation. In a case of well-conditioned equation, β is exactly equal to zero while for ill-conditioned one a small value is selected to improve conditioning. It is well known operation in numerical processing. The vector $g_m(\omega)$ represents 3-D directivity pattern desired to be formed by the beamforming block 21 at given ω for the m-th channel. As directivity pattern is in general case a function g(φ, θ) of two dimensions representing angles of azimuth and elevation (φ, θ), the result of sampling it at given frequency is a two-dimensional matrix. The vector $g_m(\omega)$ consists of concatenated columns of such matrix of samples desired for the m-th channel at given ω.

Typical choice of the shape of the directivity pattern is trigonometric polynomial function as described in Boaza Rafaely, "Fundamentals of Spherical Array Processing" and "Design of Circular Differential Microphone Arrays" by Jacob Benesty. In the latter particularly formulas for hyper- and super-cardioid are given. Formula (2.34) in the section 2.2 of said book defines general form of the trigonometric polynomial used in an example below.

Let us assume a simple case of four instruments. The number of instruments imposes a number of corresponding channels M=4. The number of channels imposes an order of cardioid as the number of nullified directions depends on the order and for each instrument the remaining three ones should be nullified for the corresponding channel. For the given example the order of the cardioid has to be equal to 3.

Under above assumptions the initial problem is to design four vectors $g_1$, $g_2$, $g_3$, $g_4$ containing samples of directivity patterns corresponding to the four channels. These four radiation patterns have to be orthogonal one to each other. Additionally, each of them has to meet condition of having maximal gain corresponding to the one instrument and zero gain corresponding to the remaining three ones. Assuming that instruments are located on the same elevation and distributed uniformly in terms of the azimuth angle, at 0°, 90°, 180°, 270° respectively, directivity patterns having cross-sections presented in FIG. 7*d-g*, respectively, can be used. Plots shown in FIG. 7*d-g* are in the logarithmic scale, namely in dB. They were obtained using formula 2.35 in chapter 2, section 2.2 of Benesty Jacob, "Design o Circular Differentials Microphone Arrays". The coefficients were determined in an optimization under the constrains given above. Assuming that 3 directions for nulling are given, three coefficients satisfying null angles in formula 2.35 of "Differential Microphone Arrays" by Jacob Benesty for general hyper/super card beampattern are to be found. The coefficients a1,a2,a3 which are common for such 3 equations are computed by system matrix inversion, where null angles are roots.

Directivity patterns should be sampled in such a manner so as to obtain vector $g_m$ of concatenated columns that has a length equal to the one dimension of H matrix of impulse responses transformed to the frequency domain, allowing matrix multiplication $H^H g_m$.

Filtration

The kind of postprocessing filtration applied depends on the kind of recorded sound and can be applied by the user. Functional block diagram of an exemplary filtration block 24 is presented In FIG. 8. It shows a case of 4 sources. Selected filtration depends on the character of the sources, namely what instruments they represent. Accordingly, for each source the user can select filtration, filtration can be selected automatically, or alternatively no filtration is applied. Four lines in parallel represent the path with no filtration. Dotted lines represent optional signal paths. Frequency weighting is executed by applying user defined frequency weights to multichannel data in the frequency domain. Remaining frequency domain processing operations are optional and executed on none, one, or more of the channels. Also, these processing operations may be channel-specific or tag-specific—if the sources corresponding to particular channels were previously tagged with tags indicating model and bandwidth occupation. These processing operations include optionally:

Wiener filtration
Kalman filtration
PCA-tracking
Spectral masking
Transient model-based post-filtering
Sinusoidal model-based post-filtering
Noise model-based post-filtering After optional execution of selected processing operations, processed signal is transformed to the time domain and outputted. The selection of processing operation is done by the steering unit 20 and depends on the instructions given by the user with the user interface when the sources were defined. Also, additional information from particular blocks executing particular processing operations may be returned to the steering unit 20.

In the simplest example of the Wiener filtration, during processing of the signal in channel $ch_y$, the signal from channel $ch_x$ that is considered unwanted is adaptively filtered and subtracted from the signal from channel $ch_y$ to meet minimum energy criterion. That approach allows for elimination of the signals reflected from walls and cross-talked to an another channel.

Further application of Wiener filtering consists in minimization of the energy with subtraction from useful signal more than one filtered channel. It is applied in the frequency domain in a frame-by-frame manner with a frame of 2048 sound samples. That means that in each step a matrix of 2048 samples×N sensors is processed. Information regarding beamforming criteria are supplied to the filtration block 24 from the steering unit 20.

The filtration block 24 receives M channels $ch_1, \ldots, ch_M$ from the beamformer block 21.

Let us consider signal ch1 in the first channel corresponding to the first source of sound, e.g. the first instrument. Signals of remaining sound sources are in ch1 treated as interferences. These signals are contained in the remaining channels $ch_2, \ldots, ch_M$.

As all operations are executed in the frequency domain, the following vectors and matrices are used:

$$\mathrm{Ch1}(\omega_i)=\mathrm{FFT}\{\mathrm{ch1}(t_k)\}$$

$$U(\omega_i)=[\mathrm{FFT}\{\mathrm{ch2}(t_k)\}, \mathrm{FFT}\{\mathrm{ch3}(t_k)\}, \ldots, \mathrm{FFT}\{\mathrm{ch}M(t_k)\}]$$

$Ch_1(\omega_i)$ represents spectrum samples resulting from transformation of the frame of 2048 samples of the signal in the channel 1, $ch_1$ to the frequency domain with fast Fourier transform. Matrix U represents spectral samples of remaining channels.

As beamformer block 21 operates also in frequency domain the processing can be done in the same frames without rebuilding the frames in between.

Let us consider a frame number $n_f$. Let us consider signal in channel 1 during this frame. Its initial spectrum is denoted with $Ch(\omega_i)$. The spectrum of the signal $Ch_1'(\omega_i)$ of the signal after filtration is calculated according to the pair of formulas:

$$\begin{cases} Ch_1'(\omega_i) = Ch_1(\omega_i) - W_w^H(\omega_i, n_f) \cdot U^T(\omega_i) \\ W_w(\omega_i, n_f + 1) = W_w^H(\omega_i, n_f) + \dfrac{\alpha U(\omega_i) Ch_1'^*(\omega_i)}{P_{est}(\omega_i, n_f)} \end{cases}$$

where $U^T$ stands for transposition of U, $Ch_1'^*$ stands for conjugation of Ch1', $\alpha$ is a constant that satisfies criterion $\alpha<2$, and in this example it is equal 1.2, $P_{est}$ is estimation of the average power calculated over subsequent frames according to the formula:

$$P_{est}(\omega_i, n_f) = \gamma P_{est}(\omega_i, n_f - 1) + (1 - \gamma) \sum_{n=1}^{N} |S_n(\omega_i)|^2,$$

where $\gamma$ is so called forgetting factor, $\gamma \in (0,1)$. In this example $\gamma$ is equal to 0.4.

Additionally return information possible regarding tuning the operation of the beamforming block 21 is optionally given to the steering unit 20.

Possible implementations of Wiener filtration are described in detail in I. A. McCowan, "Robust Speech Recognition using Microphone Arrays", PhD Thesis, Queensland University of Technology, Australia 2001.

Kalman filtration is used to speech and instrument tracking, removing pulsed, broadband sounds, e.g. drums and elimination interferences caused by side lobes if they appear either in particular audio sensor directivity pattern or in synthetized directivity pattern of whole probe 2. Possible implementations of Kalman filtering are discussed in Adaptive Filter Theory. In the present example it is implemented for vocals, as described in "Springer Handbook of Speech Processing, The Kalman Filter", section 8.4. The voice is modelled according to the autoregressive model. The same model is used for other instruments.

PCA tracking is used for removing nonpercusive sounds from drums channel and to remove drum sounds from polyphonic channels. Implementation is disclosed in article by Daniel P. Jarrett, Emanuel A. P. Habets, Patrick A. Naylor, "Eigenbeam-based Acoustic Source Tracking in Noisy Reverberant Environment", Conference Record of the Forty Fourth Asilomar Conference on Signals, Systems and Computers (ASILOMAR), 2010.

Alternative implementation is disclosed in "Extraction of drum tracks from polyphonic music using independent subspace analysis" by Christian Uhle Christian Dittmar Thomas Sporer, 4th International Symposium on Independent Component Analysis and Blind Signal Separation (ICA2003), April 2003, Nara, Japan.

Spectrum masking consists in baseband filtration based on the tag information regarding instrument type and resulting bandwidth occupation.

Model filtering is based on modeling sources and extraction of model parameters. Three models are used:

Sinusoidal model

Transient model

Noise model

Identification of source model and its parameters allows during recording that follows more effective elimination of interferences.

EXAMPLE 1

Guitar in the first channel $ch_1$ and drums in the second channel $ch_2$. The transient model describes time slots in which drums are being hit and recorded in $ch_2$. Drums generate pulsed broadband sound. That means that elimination of drums is likely to affect the useful signal in the guitar channel $ch_1$. Using information from analysis of $ch_2$ signal allows applying the pulsed interference elimination techniques exactly in the time slots when they appear and hence reduces the risk of affecting the useful signal.

EXAMPLE 2

Guitar in the first channel $ch_1$ and violin in the third channel $ch_3$. The sound of a guitar that is the useful signal in $ch_1$ is represented by a model of stable tone trajectories and transients without FM modulation. Conversely, sound of violin that is the useful signal in $ch_3$ has trajectories with apparent FM modulations. Masking all components of sound in $ch_1$ having FM modulations allows enhancing signal-to-the interference ratio as only sound of violin that is considered an interference in $ch_1$ is thereby suppressed. Inverse masking in $ch_3$ allows elimination of guitar from the violin channel.

Those skilled in the art will easily recognize that numerous other signal processing and filtration techniques can be used to extract sound of instrument from the channel and use it for elimination of this instrument from the other channels by processing it with Wiener or some other adaptive filtration schemes.

Also, the ones skilled in the art will easily recognize that once the concept of using different beamforming methods in different frequency bands to form composite spectrum $ch_m(\omega_i)$ and to finally extract resulting signal by inverse transformation of composite spectrum is disclosed, there is plurality of methods to use and numerous divisions to frequency bands can be applied.

It is also apparent from the present description that the disclosed processing can be applied basically in any audio sensor array not limited to cylindrical or spherical, even not necessarily to the shape of a solid of revolution Also specialists in the field of signal processing are able to routinely apply modes of filtering adapted to particular sound sources not mentioned above.

The invention claimed is:

1. A microphone probe having a first body being substantially a first solid of revolution with a number of audio sensors distributed thereon and located in recesses having substantially a shape of a second body of revolution having an axis of symmetry perpendicular to a surface of the first body, wherein the sensors are connected to an acquisition unit, characterized in that the audio sensors are digital audio sensors comprising a printed circuit board with at least one MEMS (microelectromechanical) microphone element mounted thereon, wherein the at least one MEMS microphone element is mounted on the side of the printed circuit board facing the interior of the first body, so that the sound reaches the at least one MEMS microphone element via the recess in the first body and an opening in the printed circuit board, wherein the depth of the recesses is in a range between 3 and 20 mm, and wherein the acquisition unit has a clocking device determining a common time base for the digital audio sensors, and wherein the acquisition unit is adapted to feed signals from particular digital audio sensors to a processing unit.

2. The microphone probe according to claim 1, characterized in that the processing unit is integrated with the microphone probe.

3. The microphone probe according to claim 1, characterized in that the acquisition unit is implemented as an FPGA (field-programmable gate array) unit with $B_F$-bit logic while the audio sensors provide $B_S$-bit samples, wherein $B_F$ is lower or equal to $B_S$, and wherein a conversion is done with a module having a $(2B_S-B_F)$-bit buffer, the module being adapted to:

write a sample into the buffer setting bits from 0 to $(B_S-1)$ with the bits of the sample and setting bits from $B_S$ to $(2B_S-B_F-1)$ with the value of the $(B_S-1)$-th bit of the sample;

apply a gain by shifting the bits of the buffer to the left by a given number of positions;

detect saturation when either bit number $(2B_S-B_F-1)$ is "0" and bits from $(2B_S-B_F-2)$ to $(B_S-1)$ are filed with "1" or bit number $(2B_S-B_F-1)$ is "1" and bits from $(2B_S-B_F-2)$ to $(B_S-1)$ are filed with "0"; and return either saturation information or the value of the bits from $(B_S-1)$ to $(B_S-B_F)$ of the buffer as a return value.

4. The microphone probe according to claim 3, characterized in that $B_F$ is equal to 16 and $B_S$ is equal to 24.

5. The microphone probe according to claim 1, characterized in that the first body is substantially spherical.

6. The microphone probe according to claim 5, characterized in that digital audio sensors are distributed in evenly spaced layers.

7. The microphone probe according to claim 5, characterized in that the digital audio sensors are distributed in parallel layers corresponding to evenly distributed angles of latitude.

8. The microphone probe according to claim 5, characterized in that it has at least 19 audio sensors.

9. The microphone probe according to claim 8 characterized in that it has 62 audio sensors.

10. The microphone probe according to claim 1, characterized in that the first body is substantially cylindrical and the audio sensors are uniformly distributed on its lateral surface.

11. A method of processing audio signals comprising the steps of:

acquiring a number of N signals from audio sensors;

determining a direction of arrival of sound originating from a number of M sources;

applying beamforming to obtain M channels corresponding to these sources from acquired signals using a filter table, characterized in that the frequency band of the acquired signals is divided at least into a first frequency band and a second frequency band, while a first beamforming method is applied in the first frequency band and a second beamforming method is applied in the second frequency band; and applying postprocessing including filtration of at least one of the M channels with a source-specific filtration wherein the value of the number of audio sensors used in beamforming depends on the frequency band and is selected so that the spacing between sensors is greater than 0.05 of the wavelength and lower than 0.5 of the wavelength in each of the frequency bands.

12. The method according to claim 11, characterized in that determining the direction of arrival of the sound originating from the M sources includes receiving at least partial indication of the location of at least one source with user interface prior, during, or after the acquisition.

13. The method according to claim 12, characterized in that the reception of at least partial indication of the location of at least one source with user interfaces precedes the acquisition of the N signals from the audio sensors and in that an additional step of determining the impulse response or the transmittance of a link between at least one source and the audio sensors is executed before the acquisition, wherein the measured impulse response or the transmittance is used to compensate the effect of environment on the sound from at least one source.

14. The method according to claim 11, characterized in that filtration includes adaptive Wiener filtration of at least first channel including adaptive filtering and subtraction of signals from at least two other channels.

15. The method according to claim 11, characterized in that the beamforming is based on correlation matrix between signals of the audio sensors.

16. The method according to claim 11, characterized in that the beamforming is based on a frequency response matrix of the audio sensors.

17. The method according to claim 16, characterized in that the frequency response matrix of the audio sensors is a result of the prior measurements in an anechoic chamber.

18. An audio acquisition system comprising a microphone probe, a processing unit, and an external interface, the microphone probe having a first body being substantially a first solid of revolution with a number of audio sensors distributed thereon and located in recesses having substantially a shape of a second body of revolution having an axis of symmetry perpendicular to a surface of the first body, wherein the sensors are connected to an acquisition unit, characterized in that the audio sensors are digital audio sensors comprising a printed circuit board with at least one MEMS (microelectromechanical) microphone element mounted thereon, wherein the at least one MEMS microphone element is mounted on the side of the printed circuit board facing the interior of the first body, so that the sound reaches the at least one MEMS microphone element via the recess in the first body and an opening in the printed circuit board, wherein the depth of the recesses is in a range between 3 and 20 mm, and wherein the acquisition unit has a clocking device determining a common time base for the digital audio sensors, and wherein the acquisition unit is adapted to feed the signals from particular digital audio sensors to, a processing unit which is adapted to carry on a method comprising the steps of:

acquiring a number N of signals from audio sensors;

determining a direction of arrival of sound originating from a M number of sources;

applying beamforming to obtain M channels corresponding to these sources from acquired signals using a filter table;

characterized in that the frequency band of the acquired signals is divided at least into a first frequency band and a second frequency band, while a first beamforming method is applied in the first frequency band and a second beamforming method is applied in the second frequency band;

applying postprocessing including filtration of at least one of the M channels with a source-specific filtration; and outputting resulting channels with the external interface.

* * * * *